US010665176B2

(12) United States Patent
Kwon et al.

(10) Patent No.: US 10,665,176 B2
(45) Date of Patent: May 26, 2020

(54) DISPLAY PANEL AND ELECTROLUMINESCENT DISPLAY USING THE SAME

(71) Applicant: LG Display Co., Ltd., Seoul (KR)

(72) Inventors: Kitae Kwon, Paju-si (KR); Kyujin Kim, Paju-si (KR); Taehun Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/024,361

(22) Filed: Jun. 29, 2018

(65) Prior Publication Data

US 2019/0005889 A1 Jan. 3, 2019

(30) Foreign Application Priority Data

Jun. 30, 2017 (KR) ..... 10-2017-0083271

(51) Int. Cl.
*G09G 5/00* (2006.01)
*G09G 3/3291* (2016.01)
(Continued)

(52) U.S. Cl.
CPC ..... *G09G 3/3291* (2013.01); *G09G 3/30* (2013.01); *G09G 3/3233* (2013.01);
(Continued)

(58) Field of Classification Search
CPC ..... G09G 3/30; G09G 3/3233; G09G 3/3291; G09G 2300/0819; G09G 2300/0842;
(Continued)

(56) References Cited

U.S. PATENT DOCUMENTS 7,557,783 B2 * 7/2009 Kim ..... G09G 3/3233 345/100
8,299,990 B2 * 10/2012 Park ..... G09G 3/2007 345/214

(Continued)

FOREIGN PATENT DOCUMENTS

KR 10-2016-0033289 A 3/2016
KR 10-2016-0063462 A 6/2016

OTHER PUBLICATIONS

Search Report dated Aug. 7, 2018 issued in the corresponding European Patent Application No. 18177531.3, 12 Pages.

*Primary Examiner* — Vijay Shankar
(74) *Attorney, Agent, or Firm* — Polsinelli PC

(57) ABSTRACT

A display panel and an electroluminescent display using the same are disclosed. The display panel includes a first data line charged with a first data signal, a second data line charged with a second data signal, a first subpixel connected to the first data line, a second subpixel connected to the second data line, a gate line commonly connected to the first and second subpixels and simultaneously supplying a gate signal to the first and second subpixels, a demultiplexer connecting an output terminal of a data driver to the first data line using MUX switch elements and then connecting the output terminal to the second data line using the MUX switch elements, and a switch array supplying a reference voltage to the second data line when the output terminal is connected to the first data line by the demultiplexer using REF switch elements.

20 Claims, 27 Drawing Sheets

101A/101B(Tini)

(51) Int. Cl.
*G09G 3/3233* (2016.01)
*G09G 3/30* (2006.01)

(52) U.S. Cl.
CPC ..... *G09G 2300/0819* (2013.01); *G09G 2300/0842* (2013.01); *G09G 2300/0861* (2013.01); *G09G 2310/0248* (2013.01); *G09G 2310/0251* (2013.01); *G09G 2310/0262* (2013.01); *G09G 2310/0297* (2013.01); *G09G 2320/043* (2013.01); *G09G 2320/045* (2013.01)

(58) Field of Classification Search
CPC ... G09G 2300/0861; G09G 2310/0248; G09G 2310/0251; G09G 2310/0262; G09G 2310/0297; G09G 2320/043; G09G 2320/045
See application file for complete search history.

(56) References Cited

U.S. PATENT DOCUMENTS

| | | | | |
|---|---|---|---|---|
| 9,870,749 | B2 * | 1/2018 | Yoo | G09G 3/3688 |
| 10,170,054 | B2 * | 1/2019 | Park | G09G 3/3233 |
| 2006/0071884 | A1 | 4/2006 | Kim | |
| 2009/0251455 | A1 | 10/2009 | Park et al. | |
| 2016/0078826 | A1 | 3/2016 | Yoo et al. | |
| 2016/0148569 | A1 | 5/2016 | Park et al. | |

* cited by examiner

101A/101B(Tini)

101A(Twr-A)

101A(Twr-B)

101B(Twr-A)

101B(Twr-B)

101B(Twr-A)

101B(Twr-B)

| LINE# | LINE 1 | | LINE 2 | |
|---|---|---|---|---|
| DATA | R | G | G | B |
| MUX | MUX2 | MUX1 | MUX2 | MUX1 |
| Vth | Long | Short | Long | Short |

| LINE | LINE 1 | | LINE 2 | |
|---|---|---|---|---|
| DATA | G | R | B | G |
| MUX | MUX2 | MUX1 | MUX2 | MUX1 |
| Vth | Long | Short | Long | Short |

| LINE | LINE 1 | | LINE 2 | |
|---|---|---|---|---|
| DATA | G | R | B | G |
| MUX | MUX1 | MUX2 | MUX1 | MUX2 |
| Vth | Long | Short | Long | Short |

| LINE | LINE 1 | | LINE 2 | |
|---|---|---|---|---|
| DATA | R | G | G | B |
| MUX | MUX1 | MUX2 | MUX1 | MUX2 |
| Vth | Long | Short | Long | Short |

DISPLAY PANEL AND ELECTROLUMINESCENT DISPLAY USING THE SAME

CROSS REFERENCE TO RELATED APPLICATION

This application claims the benefit of Korean Patent Application No. 10-2017-0083271 filed on Jun. 30, 2017, the entire contents of which is incorporated herein by reference for all purposes as if fully set forth herein.

BACKGROUND

Field of the Disclosure

The present disclosure relates to a display panel, in which a demultiplexer is disposed between a data driving circuit and data lines, and an electroluminescent display using the same.

Description of the Background

Examples of flat panel displays include a liquid crystal display (LCD), an electroluminescent display, a field emission display (FED), and a plasma display panel (PDP).

An electroluminescent display can be classified into an inorganic electroluminescent display and an organic electroluminescent display depending on the material of an emission layer. An active matrix organic light emitting diode (OLED) display includes a plurality of OLEDs capable of emitting light by themselves and has many advantages of fast response time, high emission efficiency, high luminance, wide viewing angle, and the like.

A driving circuit of a flat panel display includes a data driving circuit for supplying data signals to data lines, a gate driving circuit for supplying gate signals (or referred to as "scan signals") to gate lines (or referred to as "scan lines"), and the like. The gate driving circuit may be directly formed on the same substrate together with a thin film transistor (TFT) array of an active area constituting the screen.

Each pixel of an OLED display includes a driving element for controlling a current flowing in a light emitting element (i.e., an OLED). The driving element may be implemented as a transistor. The driving elements of all the pixels have to have the same electrical characteristics including a threshold voltage, mobility, etc. However, there is a variation in electrical characteristics between the driving elements due to process conditions, a driving environment, and the like. As a driving time of the driving element increases, a stress applied to the driving element increases. Further, the stress of the driving element varies depending on data of an input image. The electrical characteristics of the driving element can be influenced by such stress. Thus, as driving time passes, electrical characteristics of the driving elements inevitably vary.

To improve image quality and lifespan of OLED displays, a compensation circuit for compensating for driving characteristics of pixels in real time has been applied to a pixel circuit. Further, a method for distributing an output of a data driving circuit to data lines using a demultiplexer and reducing the number of output terminals of the data driving circuit has been attempted in the OLED displays. However, the method has not been adopted on the present products because a threshold voltage of driving elements of some pixels is not sensed and there is a luminance difference among the pixels.

SUMMARY

Accordingly, the present disclosure is directed to a display panel and an electroluminescent display using the same that substantially obviate one or more of problems due to limitations and disadvantages of the prior art.

More specifically, the present disclosure provides a display panel and an electroluminescent display using the same capable of compensating for a threshold voltage of a driving element in all of pixels and achieving a uniform luminance of the pixels in the electroluminescent display connecting output terminals of a data driving circuit to data lines through a demultiplexer.

Additional features and advantages of the disclosure will be set forth in the description which follows and in part will be apparent from the description, or may be learned by practice of the invention. Other advantages of the present disclosure will be realized and attained by the structure particularly pointed out in the written description and claims hereof as well as the appended drawings.

In one aspect, there is provided a display panel connected to a data driver sequentially outputting a first data signal and a second data signal through an output terminal, the display panel comprising a first data line charged with the first data signal, a second data line charged with the second data signal, a first subpixel connected to the first data line, a second subpixel connected to the second data line, a gate line commonly connected to the first and second subpixels and configured to simultaneously supply a gate signal to the first and second subpixels, a demultiplexer configured to connect the output terminal of the data driver to the first data line using a plurality of MUX switch elements and then connect the output terminal to the second data line using the plurality of MUX switch elements, and a switch array configured to supply a predetermined reference voltage to the second data line when the output terminal of the data driver is connected to the first data line by the demultiplexer using a plurality of REF switch elements.

In another one aspect, there is provided an electroluminescent display comprising a data driver configured to sequentially output a first data signal and a second data signal through an output terminal, a first data line charged with the first data signal, a second data line charged with the second data signal, a first subpixel connected to the first data line, a second subpixel connected to the second data line, a gate line commonly connected to the first and second subpixels and configured to simultaneously supply a gate signal to the first and second subpixels, a demultiplexer configured to connect the output terminal of the data driver to the first data line using a plurality of MUX switch elements and then connect the output terminal to the second data line using the plurality of MUX switch elements, and a switch array configured to supply a predetermined reference voltage to the second data line when the output terminal of the data driver is connected to the first data line by the demultiplexer using a plurality of REF switch elements, wherein each of the first and second subpixels includes a pixel circuit, wherein the pixel circuit includes a driving element for driving a light emitting element and a plurality of switch elements, wherein the pixel circuit is initialized in an initialization operation, senses a threshold voltage of the driving element in a sensing operation, and emits light in an emission operation.

BRIEF DESCRIPTION OF THE DRAWINGS

The accompanying drawings, that may be included to provide a further understanding of the disclosure and are incorporated in and constitute a part of this application, illustrate aspects of the disclosure and together with the description serve to explain various principles of the disclosure.

In the drawings.

DETAILED DESCRIPTION

Figure 1:
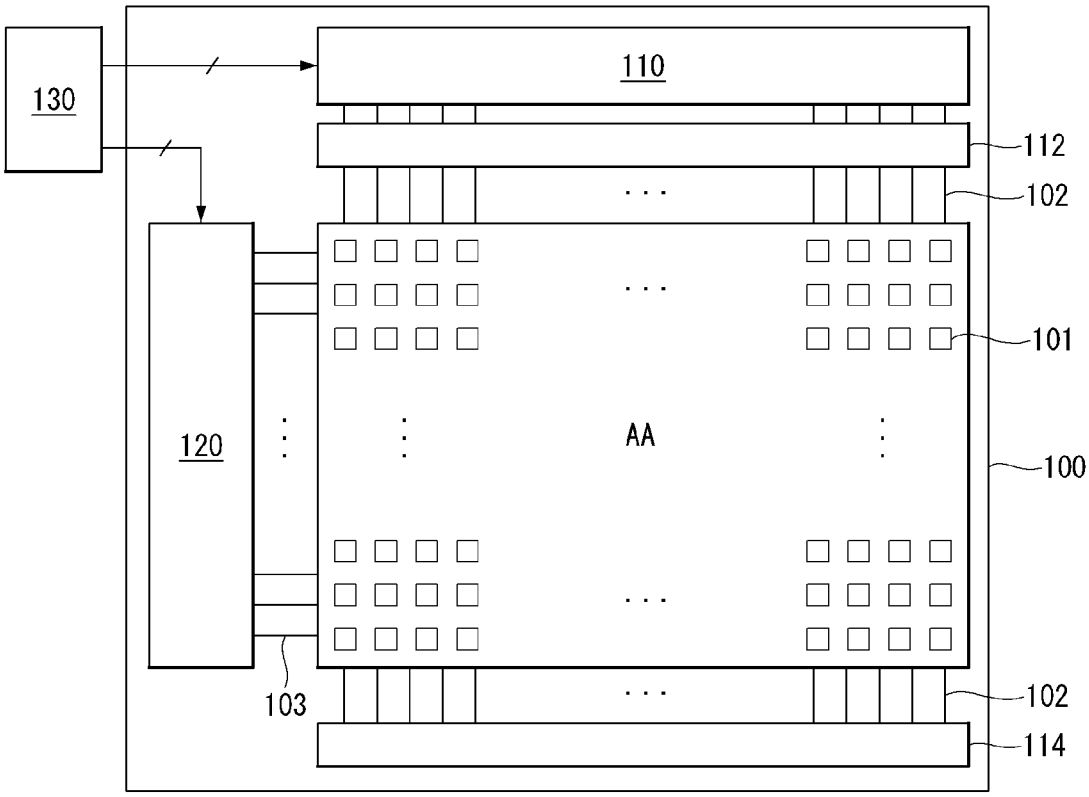
FIG. 1 is a block diagram of an electroluminescent display according to an aspect of the disclosure.

Reference will now be made in detail to aspects of the disclosure, examples of which are illustrated in the accompanying drawings. However, the present disclosure is not limited to aspects disclosed below, and may be implemented in various forms. These aspects are provided so that the present disclosure will be described more completely, and will fully convey the scope of the present disclosure to those skilled in the art to which the present disclosure pertains. Particular features of the present disclosure can be defined by the scope of the claims.

Shapes, sizes, ratios, angles, number, and the like illustrated in the drawings for describing aspects of the disclosure are merely exemplary, and the present disclosure is not limited thereto unless specified as such. Like reference numerals designate like elements throughout. In the following description, when a detailed description of certain functions or configurations related to this document that may unnecessarily cloud the gist of the disclosure have been omitted.

In the present disclosure, when the terms "include", "have", "comprised of", etc. are used, other components may be added unless "~only" is used. A singular expression can include a plural expression as long as it does not have an apparently different meaning in context.

In the explanation of components, even if there is no separate description, it is interpreted as including margins of error or an error range.

In the description of positional relationships, when a structure is described as being positioned "on or above", "under or below", "next to" another structure, this description should be construed as including a case in which the structures directly contact each other as well as a case in which a third structure is disposed therebetween.

The terms "first", "second", etc. may be used to distinguish various components. However, functions or structures of the components are not limited by names of the components and ordinal numbers prefixed to the component names.

The features of aspects of the disclosure can be partially combined or entirely combined with each other, and can be technically interlocking-driven in various ways. The aspects can be independently implemented, or can be implemented in conjunction with each other.

A pixel circuit included in an electroluminescent display according to aspects of the disclosure may include at least one of an n-type thin film transistor (TFT) (or n-type metal oxide semiconductor field effect transistor (MOSFET) (NMOS)) and a p-type TFT (or p-type MOSFET (PMOS)). The TFT is a three-electrode element including a gate, a source, and a drain. The source is an electrode for supplying carriers to the TFT. The carriers inside the TFT begin to flow from the source. The drain is an electrode from which carriers exit the TFT. Namely, carriers in the TFT flow from the source to the drain. In case of the n-type TFT, because carriers are electrons, a source voltage is less than a drain voltage so that electrons can flow from a source to a drain. In the n-type TFT, because electrons flow from the source to the drain, a current flows from the drain to the source. In case of the p-type TFT, because carriers are holes, a source voltage is greater than a drain voltage so that holes can flow from a source to a drain. In the p-type TFT, because holes flow from the source to the drain, a current flows from the source to the drain. In aspects disclosed herein, the source and the drain of the TFT are not fixed. For example, the source and the drain of the TFT may be changed depending on an applied voltage. Thus, the present disclosure is limited by the source and the drain of the TFT. In the following description, the source and the drain of the TFT are referred to as a first electrode and a second electrode, respectively.

A gate signal applied to the pixel circuit swings between a gate-on voltage and a gate-off voltage. The gate-on voltage is set to a voltage greater than a threshold voltage of the TFT, and the gate-off voltage is set to a voltage less than the threshold voltage of the TFT. The TFT is turned on in response to the gate-on voltage and is turned off in response to the gate-off voltage. In case of an n-type TFT, the gate-on voltage may be a gate high voltage VGH, and the gate-off voltage may be a gate low voltage VGL. In case of a p-type TFT, the gate-on voltage may be the gate low voltage VGL, and the gate-off voltage may be the gate high voltage VGH.

In the following aspects, an electroluminescent display will be described focusing on an organic light emitting diode (OLED) display including an organic light emitting material. However, the technical idea of the present disclosure is not limited to the OLED display. For example, the present disclosure may be applied to an inorganic electroluminescent display including an inorganic electroluminescent material.

Aspects of the disclosure supply a data voltage output from a data driver through one channel to N data lines using a demultiplexer (or referred to as "DEMUX") in a time division manner, where N is an even number equal to or greater than 2. In the following description, a demultiplexer having a 1:2 MUX structure, in which one output terminal of a data driver is connected to two data lines, is described as an example. However, aspects are not limited thereto.

Figure 2:
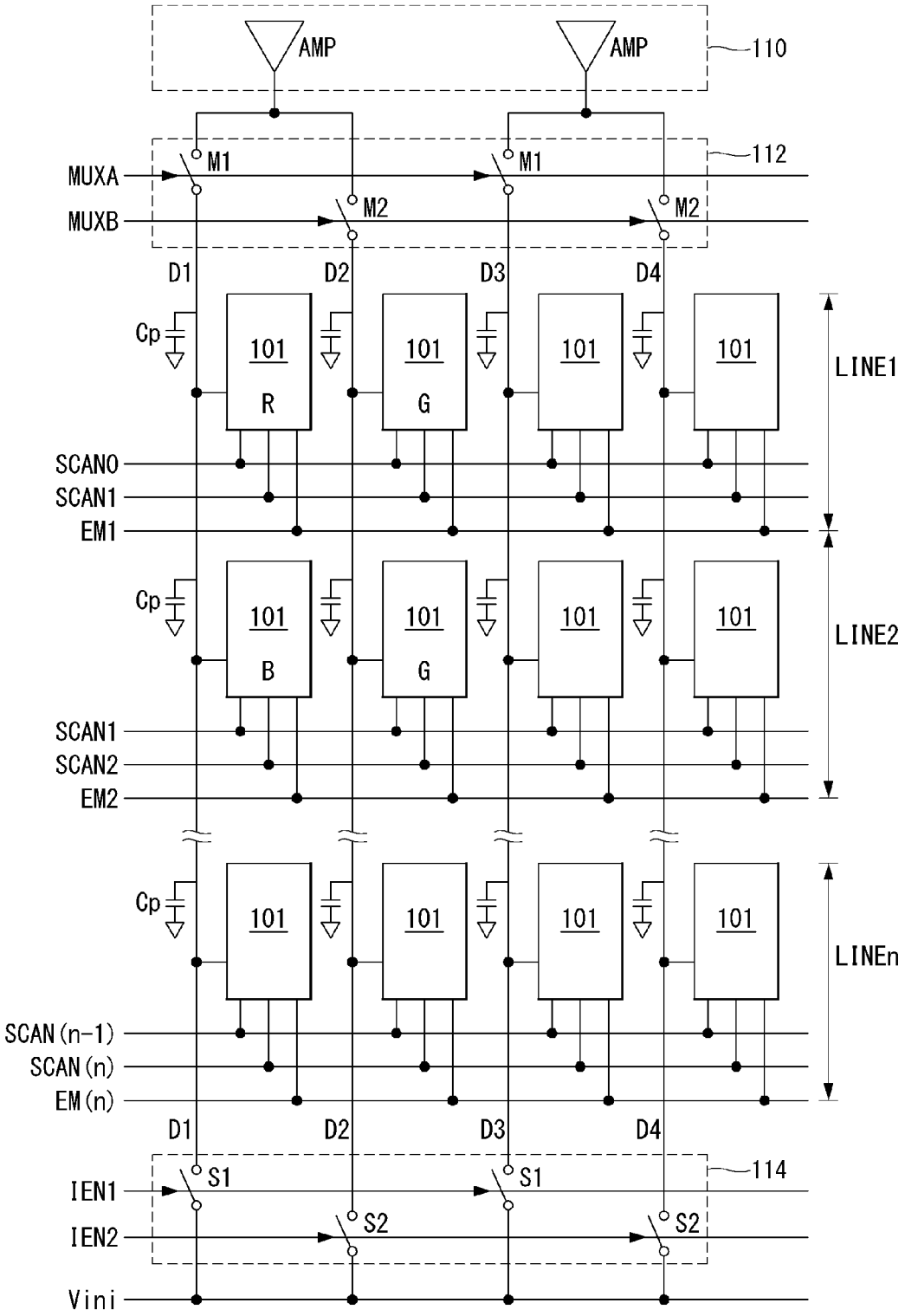
FIG. 2 illustrates a demultiplexer connected to data lines and switch elements of a switch array.

Referring to FIGS. 1 and 2, an electroluminescent display according to an aspect of the disclosure includes a display panel 100 and a display panel driving circuit.

The display panel 100 includes an active area AA where an input image is displayed on a screen. A pixel array is disposed in the active area AA. The pixel array includes signal lines and pixels arranged in a matrix form. The signal lines include data lines 102 and gate lines 103 intersecting the data lines 102. Power lines may be disposed on the pixel array. In FIG. 2, "LINE1 to LINEn" each indicate a pixel line including pixels sharing the gate line in the pixel array. For example, "LINEn" is an nth pixel line, where n is a positive integer.

Each pixel may include a red subpixel, a green subpixel, and a blue subpixel for color representation. Each pixel may further include a white subpixel. Each subpixel 101 includes a pixel circuit. The pixel circuit includes a light emitting element, a driving element, one or more switch elements, a capacitor, and the like. The driving element and the switch elements may be implemented as TFTs.

The display panel 100 may further include VDD lines for supplying a pixel driving voltage VDD to the subpixels 101, Vini lines for supplying an initialization voltage Vini for initializing the pixel circuit to the subpixels 101, VSS electrodes for supplying a low potential power voltage VSS to the subpixels 101, VGH lines supplied with a gate high voltage VGH, VGL lines supplied with a gate low voltage VGL, and the like. Power voltages including the VDD, the Vini, the VSS, etc. are generated from a power circuit (not shown). For example, the power voltages may be set as follows: VDD=4.5V, VSS=−2.5V, Vini=−3.5V, VGH=7.0V, VGL=−5.5V. However, aspects are not limited thereto. The power voltages may vary depending on driving characteristics or models of the display panel 100.

Touch sensors may be disposed on the display panel 100. A touch input may be sensed using separate touch sensors or sensed through the pixels. The touch sensors may be implemented as on-cell touch sensors or add-on touch sensors and disposed on the screen of the display panel 100. Alternatively, the touch sensors may be implemented as in-cell touch sensors that are embedded in the pixel array.

The display panel driving circuit includes a data driver 110 and a gate driver 120. The display panel driving circuit further includes a demultiplexer 112 between the data driver 110 and the data lines 102 and a switch array 114 for supplying the initialization voltage Vini to at least some of the data lines 102.

The display panel driving circuit writes data of an input image to the pixels of the display panel 100 under the control of a timing controller 130. The display panel driving circuit may further include a touch sensor driver for driving the touch sensors. The touch sensor driver is omitted in FIG. 1. In mobile devices, the display panel driving circuit, the timing controller 130, and the power circuit may be integrated into one integrated circuit.

The display panel driving circuit may operate in a low refresh driving mode. The low refresh driving mode is set to reduce power consumption of a display device when there is no change in an input image for a predetermined time as a result of the analysis of the input image. In other words, the low refresh driving mode can increase a data writing cycle of pixels by reducing a refresh rate (or referred to as "frame rate") of the pixels when a still image is input for a predetermined time or more, thereby reducing the power consumption of the display device. The low refresh driving mode is not limited to when the still image is input. For example, the display panel driving circuit can operate in the low refresh driving mode when the display device operates in a standby mode or when a user command or an input image is not input to the display panel driving circuit for a predetermined time or more.

The data driver 110 converts digital data of an input image received from the timing controller 130 into a gamma compensation voltage and generates a data signal in each frame period. The data driver 110 outputs a voltage (hereinafter referred to as "data voltage") of the data signal in each output terminal through an output buffer AMP.

The demultiplexer 112 is disposed between the data driver 110 and the data lines 102. The demultiplexer 112 distributes the data voltage output from the data driver 110 to the data lines 102 using a plurality of switch elements M1 and M2. As shown in FIG. 2, the demultiplexer 112 may distribute one output channel of the data driver 110 to the two data lines. In this instance, the demultiplexer 112 includes a plurality of first switch elements M1 connecting a first data line group including data lines D1 and D3 to output terminals of the data driver 110 and a plurality of second switch elements M2 connecting a second data line group including data lines D2 and D4 to output terminals of the data driver 110.

The switch array 114 includes a plurality of switch elements S1 and S2 for supplying the initialization voltage Vini to the subpixels 101 before the data voltage is applied. More specifically, the switch array 114 includes a plurality of first switch elements S1 connecting the first data line group including the data lines D1 and D3 to initialization voltage lines and a plurality of second switch elements S2 connecting the second data line group including the data lines D2 and D4 to initialization voltage lines. The demultiplexer 112, the switch array 114, and the gate driver 120 may be disposed on the display panel 100 together with the pixel array.

As shown in FIGS. 1 and 2, the demultiplexer 112 may be connected to one ends of the data lines 102, and the switch array 114 may be connected to the other ends of the data lines 102. However, aspects are not limited thereto. For example, the demultiplexer 112 and the switch array 114 may be disposed together in a bezel area on one side of the display panel 100, so that they are connected to one of both ends of the data lines.

The pixel circuits of the subpixels 101, the demultiplexer 112, the switch array 114, and the gate driver 120 may be formed directly on a substrate of the display panel 100 in the same manufacturing process. Transistors of the pixel circuits, the demultiplexer 112, the switch array 114, and the gate driver 120 may be implemented as NMOS or PMOS transistors and may be implemented as transistors of the same type.

The gate driver 120 outputs gate signals to the gate lines 103 under the control of the timing controller 130. The gate driver 120 shifts the gate signals using a shift register and can sequentially supply the gate signals to the gate lines 103.

The gate signals include scan signals SCAN0 to SCANn for selecting pixels of a pixel line on which data is to be written, and emission switching signals (hereinafter referred to as "EM signals") EM1 to EMn defining an emission time of pixels charged with the data voltage.

The timing controller 130 receives digital video data DATA of an input image and timing signals synchronized with the digital video data DATA from a host system (not shown). The timing signals include a vertical sync signal Vsync, a horizontal sync signal Hsync, a data enable signal DE, a clock signal DCLK, and the like. The host system may be one of a television system, a set-top box, a navigation system, a personal computer (PC), a home theater system, a mobile device, and other systems that include or operate in conjunction with a display device.

The timing controller 130 multiplies an input frame frequency by "i" and can control operation timing of the display panel driving circuits (110, 112, 114, and 120) at a frame frequency of (i.e., input frame frequency×i) Hz, where "i" is a positive integer greater than zero. The input frame frequency is 50 Hz in a phase alternate line (PAL) scheme and is 60 Hz in the national television standards committee (NTSC) scheme. In the low refresh driving mode, the timing controller 130 may reduce the frame frequency to 1 Hz to 30 Hz in order to reduce a refresh rate of the pixels.

The timing controller 130 generates a data timing control signal for controlling operation timing of the data driver 110, switch control signals MUXA, MUXB, IEN1 and IEN2 for controlling operation timings of the demultiplexer 112 and the switch array 114, and a gate timing control signal for controlling operation timing of the gate driver 120 based on the timing signals Vsync, Hsync, DE, and DCLK received from the host system. Voltage levels of the gate timing control signal and the switch control signals MUXA, MUXB, IEN1 and IEN2 output from the timing controller 130 may be converted into a gate-on voltage and a gate-off voltage through a level shifter (not shown) and may be supplied to the gate driver 120. The level shifter converts a low level voltage of the gate timing control signal into the gate low voltage VGL and converts a high level voltage of the gate timing control signal into the gate high voltage VGH.

Figure 3:
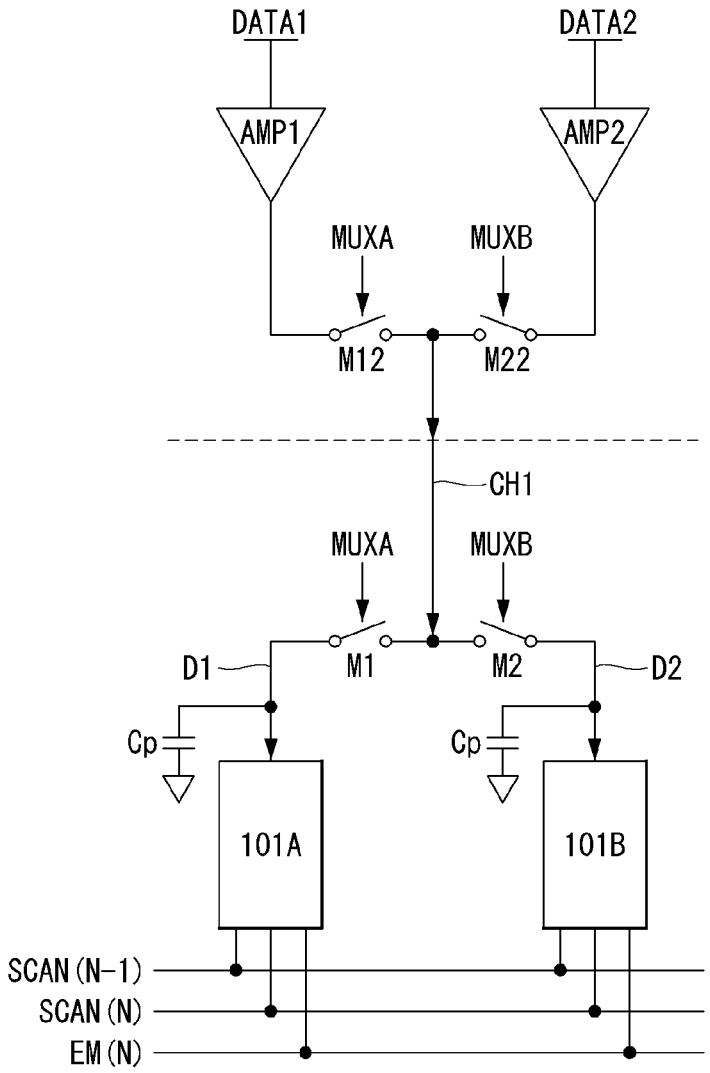
FIG. 3 illustrates a part of a demultiplexer.
Figure 4:
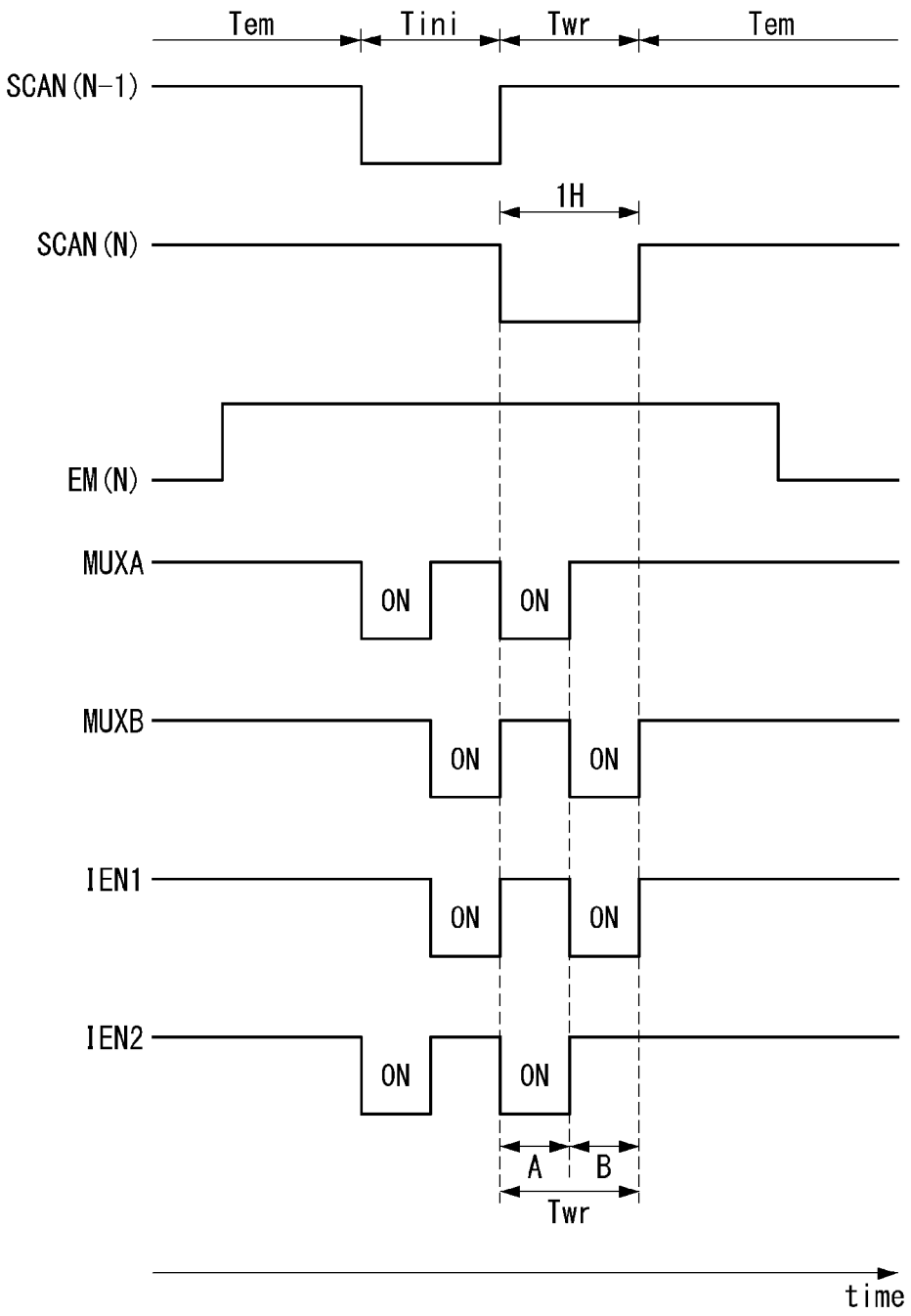
FIGS. 4 and 5 are waveform diagrams illustrating switch control signals and gate signals.
Figure 5:
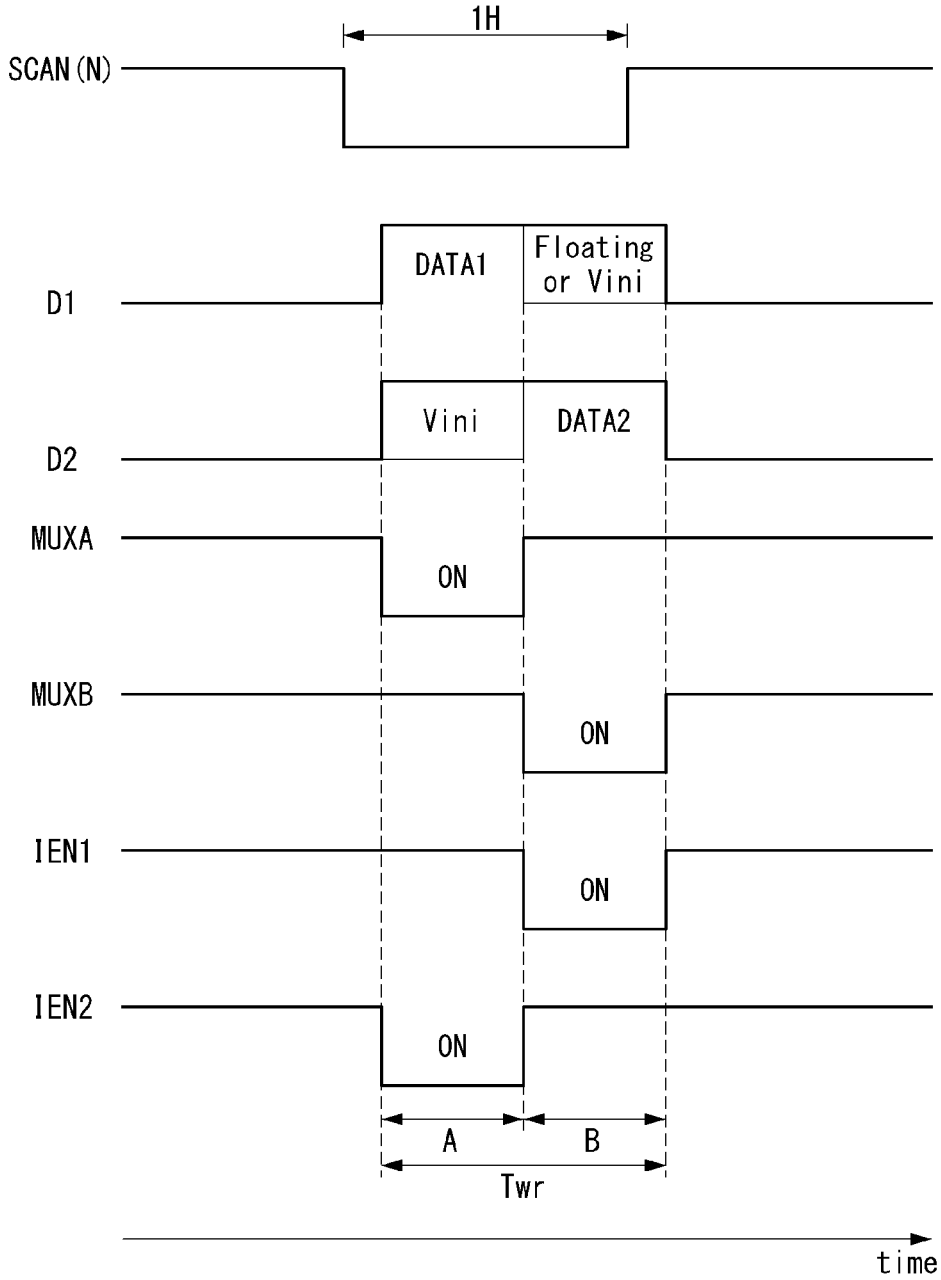

FIG. 3 illustrates a part of the demultiplexer 112. FIGS. 4 and 5 are waveform diagrams illustrating the switch control signals MUXA, MUXB, IEN1 and IEN2 and the gate signals SCAN(N−1), SCAN(N) and EN(N) when the switch elements of the demultiplexer 112 and the switch array 114 are implemented as PMOS transistors in the same manner as the switch elements of the pixel circuit. In FIGS. 4 and 5, "ON" denoted on the switch control signals MUXA, MUXB, IEN1 and IEN2 is an ON-time period in which the switch elements of the demultiplexer 112 and the switch array 114 are turned on. When the switch elements of the demultiplexer 112 and the switch array 114 are implemented as NMOS transistors, the switch control signals MUXA, MUXB, IEN1 and IEN2 are generated as antiphase signals of those shown in FIGS. 4 and 5.

Referring to FIGS. 3 to 5, the demultiplexer 112 includes first and second switch elements M1 and M2 connected to a first output terminal CH1 of the data driver 110.

The data driver 110 time-divides the data signal into a first data signal DATA1 and a second data signal DATA2 and sequentially outputs the first data signal DATA1 and the second data signal DATA2 through the first output terminal CH1 for one horizontal period 1H. One horizontal period 1H is time required to apply the data signal to pixels disposed on one pixel line.

The first switch element M1 is disposed between the first output terminal CH1 and a first data line D1. The first switch element M1 is turned on in response to the first switch control signal MUXA and supplies the first data signal DATA1 applied through the first output terminal CH1 to the first data line D1. A first subpixel 101A connected to the first data line D1 is supplied with the first data signal DATA1 through the first switch element M1. The second switch element M2 is disposed between the first output terminal CH1 and a second data line D2. The second switch element M2 is turned on in response to the second switch control signal MUXB and supplies the second data signal DATA2 applied through the first output terminal CH1 to the second data line D2. A second subpixel 101B connected to the second data line D2 is supplied with the second data signal DATA2 through the second switch element M2. The first and second subpixels 101A and 101B share a gate line with each other and are supplied with scan signals SCAN synchronized with the first and second data signals DATA1 and DATA2 through the shared gate line. After the first subpixel 101A is supplied with the first data signal DATA1 during an A period, the second subpixel 101B is supplied with the second data signal DATA2 during a B period. Each of the A period and the B period is about ½ horizontal period ½ H.

Each of the scan signals SCAN(N−1) and SCAN(N) may be generated as a pulse of one horizontal period 1H. The (N−1)th scan signal SCAN(N−1) is supplied to pixels of an (N−1)th pixel line and pixels of an Nth pixel line, where N is a positive integer greater than zero. During one horizontal period 1H in which a pulse of the (N−1)th scan signal SCAN(N−1) is generated, the pixels of the (N−1)th pixel line perform a process (hereinafter referred to as "Twr operation") for sensing a threshold voltage and writing data in the driving element, and at the same time the pixels of the Nth pixel line perform an initialization process (hereinafter referred to as "Tini operation"). The Nth scan signal SCAN (N) is supplied to the pixels of the Nth pixel line and pixels of an (N+1)th pixel line. During one horizontal period 1H in which a pulse of the Nth scan signal SCAN(N) is generated, the pixels of the Nth pixel line perform the Twr operation, and at the same time the pixels of the (N+1)th pixel line perform the Tini operation.

The Twr operation is divided into the A period and the B period. The A period is time required to charge subpixels belonging to a first pixel group with the data voltage and to charge subpixels belonging to a second pixel group with the initialization voltage Vini. The B period is time required to charge or float the subpixels belonging to the first pixel group with the initialization voltage Vini and to charge the subpixels belonging to the second pixel group with the data voltage. In aspects disclosed herein, the first pixel group includes subpixels operating in the same way as the first subpixel 101A, and the second pixel group includes subpixels operating in the same way as the second subpixel 101B. Positions of the first pixel group and the second pixel group may be reversed every a predetermined time, for example, every N frame period, where N is a positive integer greater than zero.

The EM signal EM(N) defines a light emission operation Tem (hereinafter referred to as "EM period") of the light emitting element of the pixel circuit. The EM signal EM(N) is generated as a pulse of the gate-off voltage for time in which the EM signal EM(N) overlaps the (N−1)th scan signal SCAN(N−1) and the Nth scan signal SCAN(N). The EM signal EM(N) is held at the gate-on voltage in most of a remaining time excluding a width of the pulse of the gate-off voltage from one frame period. During the EM period Tem, third and fourth switching TFT elements T3 and T4 are turned on due to an ON-time period of the EM signal EM(N) as shown in FIGS. 6 to 8B. During the EM period Tem, a current path of the light emitting element is formed.

The driving element of the pixel circuit is driven in accordance with a gate-to-source voltage Vgs for time, in which the EM signal EM(N) is generated at the gate-on voltage, and supplies a current to the light-emitting element. Thus, the light emitting element of the pixel circuit can emit light during the EM period Tem.

Each of the first and second switch control signals MUXA and MUXB may be generated as a pulse of a ½ horizontal period. The first and second switch control signals MUXA and MUXB do not overlap each other so that the first and second switch elements M1 and M2 are not simultaneously turned on. For example, after the first switch element M1 is turned on, the second switch element M2 may be turned on. On the contrary, after the second switch element M2 is turned on, the first switch element M1 may be turned on.

The data driver 110 may include switch elements M12 and M22 that are synchronized with the demultiplexer 112. The third switch element M12 is disposed between a first output buffer AMP1 and the first output terminal CH1. The third switch element M12 is turned on in response to the first switch control signal MUXA at the same time as the first switch element M1 and outputs the first data signal DATA1 through the first output terminal CH1. The fourth switch element M22 is disposed between a second output buffer AMP2 and the first output terminal CH1. The fourth switch element M22 is turned on in response to the second switch control signal MUXB at the same time as the second switch element M2 and outputs the second data signal DATA2 through the first output terminal CH1.

The first data line D1 is charged with the first data signal DATA1 supplied through the switch element M1 during the A period and then is floated or charged with the initialization voltage Vini during the B period. The fact that the first data line D1 is floated means that the switch elements M1 and S1 connected to the first data line D1 are turned off and thus no signal or voltage is applied to the first data line D1. The switch element S1 of the switch array 114 may be turned on in response to the first switch control signal IEN1 during the B period and may supply the initialization voltage Vini to the first data line D1. Alternatively, the switch element S1 of the switch array 114 may maintain an off-state during the B period so that the first data line D1 is floated.

The second data line D2 is charged with the initialization voltage Vini during the A period and then is charged with the second data signal DATA2 during the B period. The switch element S2 of the switch array 114 is turned on in response to the second switch control signal IEN2 during the A period and supplies the initialization voltage Vini to the second data line D2, so that malfunction of the second subpixel 101A is prevented.

Each data line 102 of the display panel 100 includes a parasitic capacitance Cp. If the switch array 114 is not provided, the subpixels of the second pixel group may malfunction in the A period due to the parasitic capacitance Cp. The switch array 114 applies the initialization voltage Vini to the data lines connected to the second subpixel 101B during the A period to thereby prevent the malfunction of the second pixel group.

FIGS. 6 to 8B illustrate a pixel circuit according to an aspect of the present disclosure and an operation of the pixel circuit, by way of example. Thus, aspects are not limited to the pixel circuit illustrated in FIGS. 6 to 8B.

Figure 6:
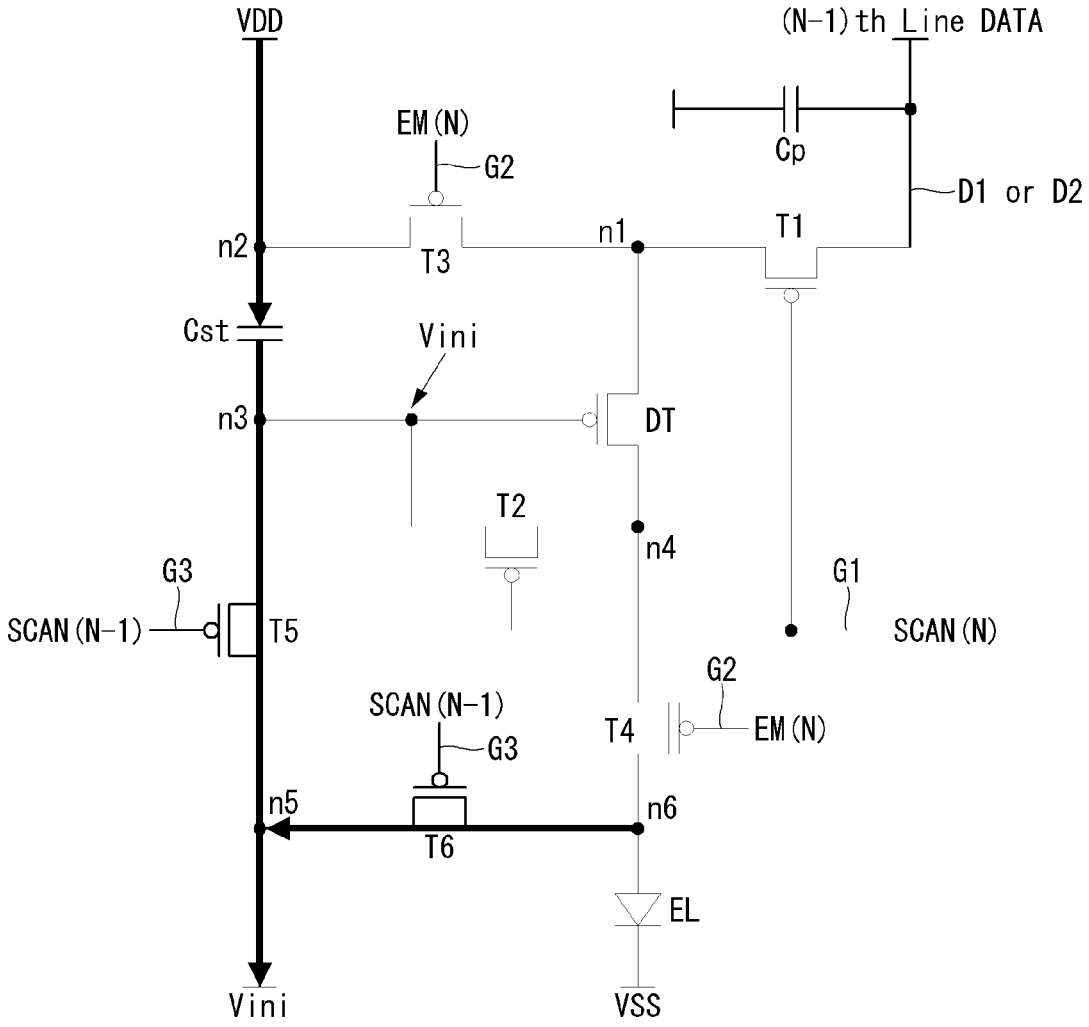
FIG. 6 is a circuit diagram illustrating operations of first and second subpixels in an initialization operation.

FIG. 6 is a circuit diagram illustrating operations of first and second subpixels in a Tini operation.

Referring to FIG. 6, each of first and second subpixels 101A and 101B includes a compensation circuit that compensates for a data voltage in real time as much as a threshold voltage of a driving element in each frame period. A pixel circuit according to an aspect of the present disclosure includes a light emitting element EL, a plurality of TFTs T1 to T6 and DT, a storage capacitor Cst, and the like.

The TFTs T1 to T6 and DT may be implemented as p-type TFTs or PMOS transistors. However, aspects are not limited thereto.

The switching TFTs T1 to T6 are turned on or off in response to the gate signal from the gate line and thus initialize the pixel circuit in a Tini operation. Subsequently, in a Twr operation, the switching TFTs T1 to T6 sense a threshold voltage Vth of the driving element DT and supply a gate of the driving element DT with a data voltage that is compensated as much as the threshold voltage Vth. In an EM period Tem, the switching TFTs T1 to T6 form a current path between the VDD and the light emitting element EL and cause the light emitting element EL to emit light.

The light emitting element EL may be implemented as an OLED. The OLED includes an organic compound layer between an anode and a cathode. The organic compound layer may include a hole injection layer HIL, a hole transport layer HTL, an emission layer EML, an electron transport layer ETL, and an electron injection layer EIL. However, aspects are not limited thereto. When a power voltage is applied to the anode and the cathode, holes passing through the hole transport layer HTL and electrons passing through the electron transport layer ETL move to the emission layer EML and combine, thereby forming excitons. As a result, the emission layer EML generates visible light by the excitons. The OLED emits light with an amount of current that is controlled by the driving element DT. The anode of the OLED is connected to the fourth and sixth switching TFTs T4 and T6 through a sixth node n6. The cathode of the OLED is connected to the VSS electrode supplied with the low potential power voltage VSS. A current path of the OLED is switched by the fourth switching TFT T4.

A first electrode of the storage capacitor Cst is connected to the VDD line and a first electrode of the third switching TFT T3 through a second node n2. A second electrode of the storage capacitor Cst is connected to the gate of the driving TFT DT, a first electrode of the second switching TFT T2, and a first electrode of the fifth switching TFT T5 through a third node n3.

The first switching TFT T1 is a switch element for supplying data lines D1 and D2 to a first node n1 in response to the Nth scan signal SCAN(N). The first switching TFT T1 includes a gate connected to a first gate line G1, a first electrode connected to the data lines D1 and D2, and a second electrode connected to the first node n1. The Nth scan signal SCAN(N) is applied to the pixel circuit through the first gate line G1.

The second switching TFT T2 connects the third node n3 to a fourth node n4 in response to the Nth scan signal SCAN(N). The gate and a drain of the driving TFT DT are connected by the second switching TFT T2, and thus the driving TFT DT can operate as a diode. The second switching TFT T2 includes a gate connected to the first gate line G1, a first electrode connected to the third node n3, and a second electrode connected to the fourth node n4.

The third switching TFT T3 connects the VDD line to the first node n1 in response to the EM signal EM(N). The third switching TFT T3 includes a gate connected to a second gate line G2 supplied with the EM signal EM(N), a first electrode connected to the VDD line through the second node n2, and a second electrode connected to the first node n1.

The fourth switching TFT T4 switches a current path of the light emitting element EL in response to the EM signal EM(N). A gate of the fourth switching TFT T4 is connected to the second gate line G2. A first electrode of the fourth switching TFT T4 is connected to a second electrode of the driving TFT DT and the second electrode of the second switching TFT T2 through the fourth node n4. A second electrode of the fourth switching TFT T4 is connected to a second electrode of the sixth switching TFT T6 and the anode of the light emitting element EL through the sixth node n6.

The fifth switching TFT T5 connects the third node n3 to a fifth node n5 in response to the (N−1)th scan signal SCAN(N−1). The fifth switching TFT T5 includes a gate connected to a third gate line G3 supplied with the (N−1)th scan signal SCAN(N−1), a first electrode connected to the second electrode of the storage capacitor Cst through the third node n3, and a second electrode connected to the Vini line and a first electrode of the sixth switching TFT T6 through the fifth node n5.

The sixth switching TFT T6 connects the fifth node n5 to the sixth node n6 in response to the (N−1)th scan signal SCAN(N−1). The sixth switching TFT T6 includes a gate connected to the third gate line G3, the first electrode connected to the second electrode of the fifth switching TFT T5 and the Vini line through the fifth node n5, and the second electrode connected to the second electrode of the fourth switching TFT T4 and the anode of the light emitting device EL through the sixth node n6.

The driving TFT DT controls a current flowing in the light emitting element EL depending on the gate-to-source voltage Vgs. The driving TFT DT includes the gate connected to the third node n3, a first electrode connected to the first node n1, and the second electrode connected to the fourth node n4.

In the Tini operation of the first and second subpixels 101A and 101B disposed on the Nth pixel line, the (N−1)th scan signal SCAN(N−1) is generated as a pulse of the gate-on voltage, and the Nth scan signal SCAN(N) and the EM signal EM(N) are held at the gate-off voltage. Thus, in the Tini operation, the fifth and sixth switching TFTs T5 and T6 are turned on, and the remaining switching TFTs T1 to T4 maintain an off-state. In the Tini operation, the second node n2 is initialized to the VDD, and the third, fifth, and sixth nodes n3, n5 and n6 are initialized to the Vini.

Figure 7A:
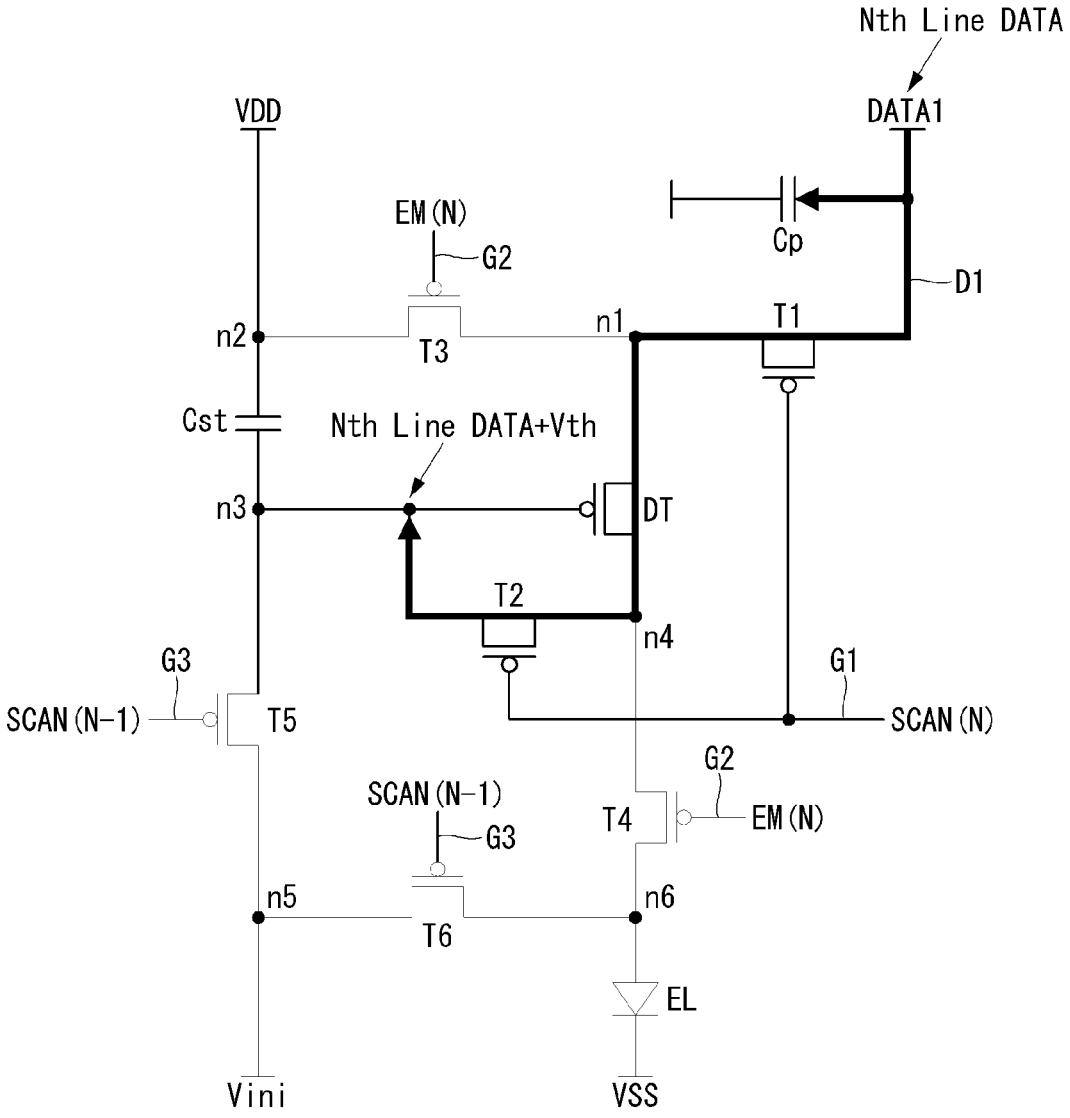
FIGS. 7A and 7B are circuit diagrams illustrating an operation of a first subpixel in a process for sensing a threshold voltage and writing data in a driving element.
Figure 7B:
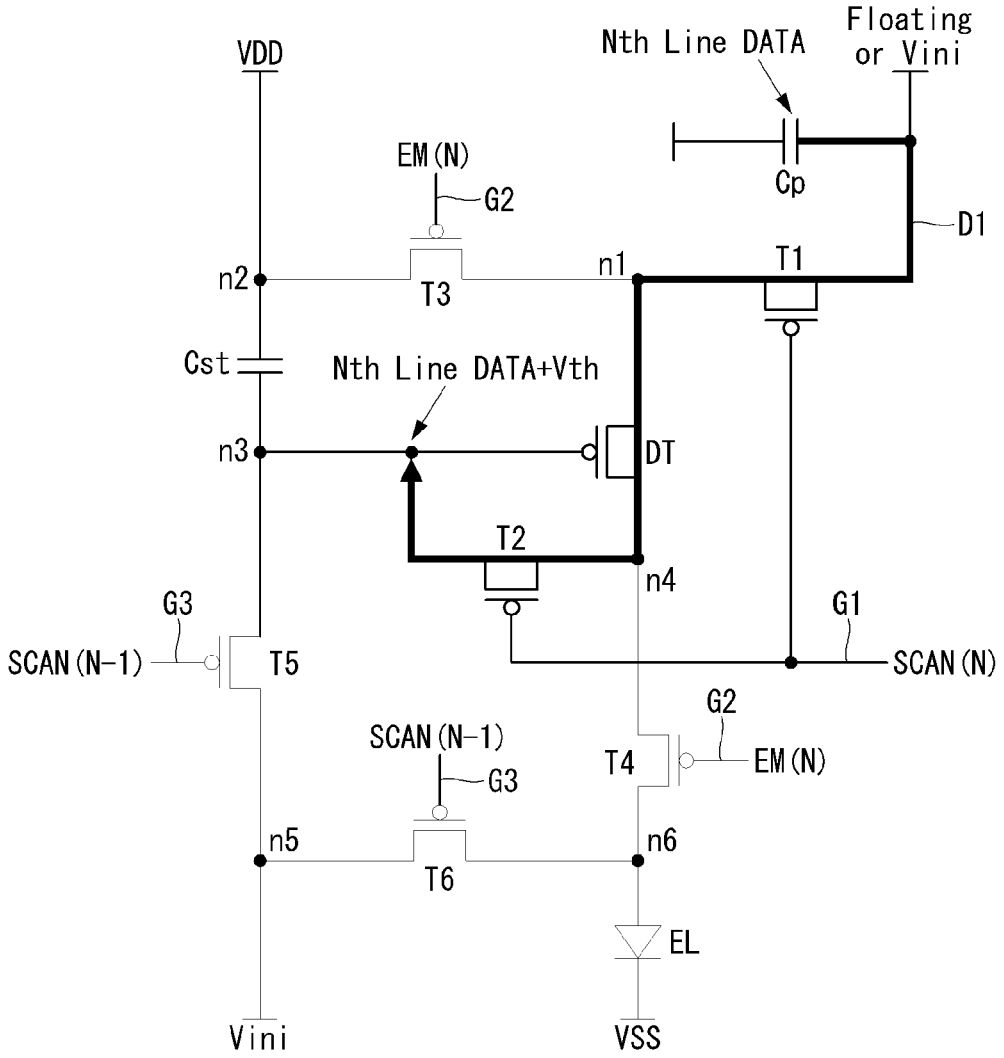

FIGS. 7A and 7B are circuit diagrams illustrating an operation of the first subpixel 101A in the Twr operation. The Twr operation of the first subpixel 101A on the Nth pixel line is divided into an A period Twr-A and a B period Twr-B.

Referring to FIG. 7A, the Nth scan signal SCAN(N) is generated as a pulse of the gate-on voltage in the Twr operation. During the A period Twr-A, the (N−1)th scan signal SCAN(N−1) and the EM signal EM(N) are held at the gate-off voltage. During the A period Twr-A of the first subpixel 101A, the first and second switching TFTs T1 and T2 are turned on, and the remaining switching TFTs T3 to T6 maintain an off-state. In this instance, data signals Nth Line DATA and DATA1 of the Nth pixel line are applied to the first data line D1 in synchronization with the Nth scan signal SCAN(N). Thus, in the A period Twr-A, because the driving TFT DT is turned on until a voltage of the driving TFT DT reaches "Nth Line DATA+Vth", a gate voltage of the driving TFT DT, i.e., a voltage of the third node n3 is "Nth Line DATA+Vth".

Referring to FIG. 7B, during the B period Twr-B, the first and second switching TFTs T1 and T2 are turned on, and the remaining switching TFTs T3 to T6 maintain an off-state. In this instance, the first data line D1 is floated or charged with the initialization voltage Vini. When the first data line D1 is floated as described above, the voltage of the first data line D1 is held at "Nth line DATA" due to a voltage stored in a parasitic capacitance Cp connected to the first data line D1. Hence, the gate voltage of the driving TFT DT, i.e., the voltage of the third node n3 is "Nth Line DATA+Vth".

During the B period Twr-B, when the initialization voltage Vini is applied to the first data line D1, a source voltage of the driving TFT DT, i.e., a voltage of the first node n1 is reduced to a value equal to or less than the gate voltage of the driving TFT DT. Therefore, the driving TFT DT is turned off, and the gate voltage of the driving TFT DT is held at "Nth Line DATA+Vth".

Figure 8A:
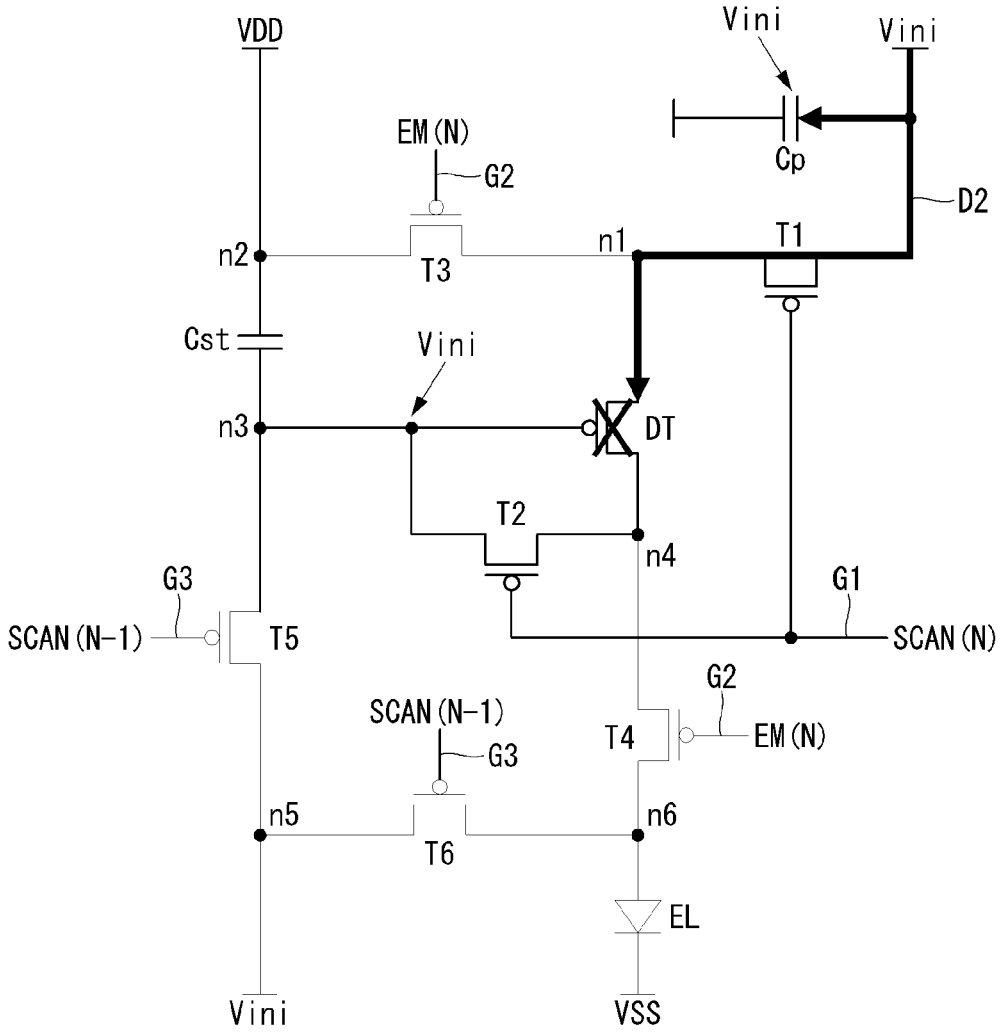
FIGS. 8A and 8B are circuit diagrams illustrating an operation of a second subpixel in a process for sensing a threshold voltage and writing data in a driving element.
Figure 8B:
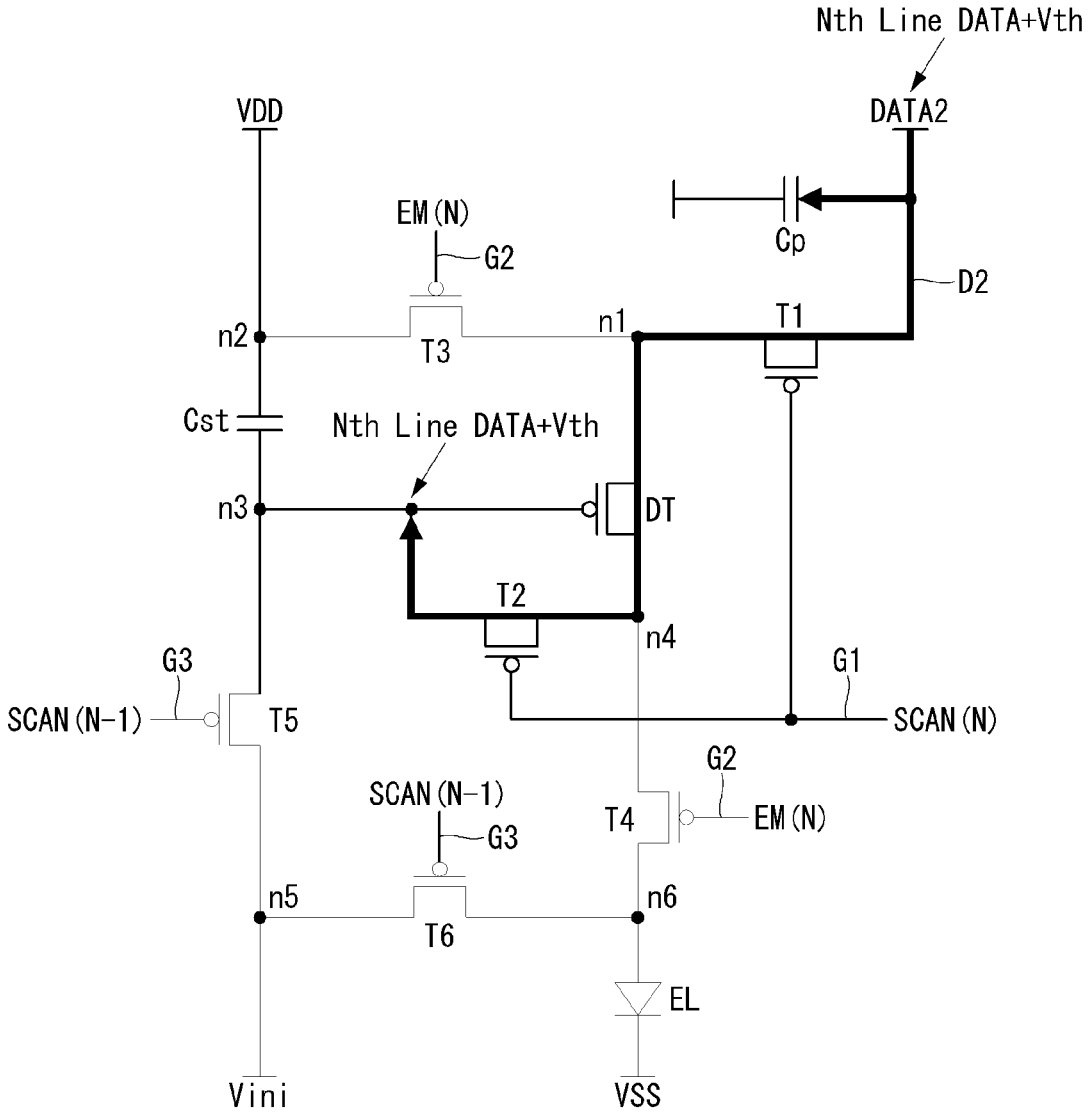

FIGS. 8A and 8B are circuit diagrams illustrating an operation of the second subpixel 101B in the Twr operation.

Referring to FIG. 8A, the Nth scan signal SCAN(N) is generated as a pulse of the gate-on voltage in the Twr operation. During the A period Twr-A, the (N−1)th scan signal SCAN(N−1) and the EM signal EM(N) are held at the gate-off voltage. During the A period Twr-A of the second subpixel 101B, the first and second switching TFTs T1 and T2 are turned on, and the remaining switching TFTs T3 to T6 maintain an off-state. In this instance, the initialization voltage Vini is applied to the second data line D2 in synchronization with the Nth scan signal SCAN(N). Thus, in the A period Twr-A, because the driving TFT DT is turned off when the gate voltage and the source voltage of the driving TFT DT are the initialization voltage Vini, the gate voltage and the source voltage of the driving TFT DT are the initialization voltage Vini.

Referring to FIG. 8B, during the B period Twr-B, the first and second switching TFTs T1 and T2 are turned on, and the remaining switching TFTs T3 to T6 maintain an off-state. In this instance, data signals Nth Line DATA and DATA2 of the Nth pixel line are applied to the second data line D2 in synchronization with the Nth scan signal SCAN(N). Thus, in the B period Twr-B, because the driving TFT DT is turned on until the voltage of the driving TFT DT reaches "Nth Line DATA+Vth", the gate voltage of the driving TFT DT is "Nth Line DATA+Vth".

During the EM period Tem, the light emitting element EL emits light by the driving TFT DT driven depending on the gate-to-source voltage Vgs. The gate voltage of the driving TFT DT is held at the data voltage "Nth Line DATA+Vth" that is compensated as much as the threshold voltage Vth of the driving TFT DT due to the storage capacitor Cst.

Figure 10A:
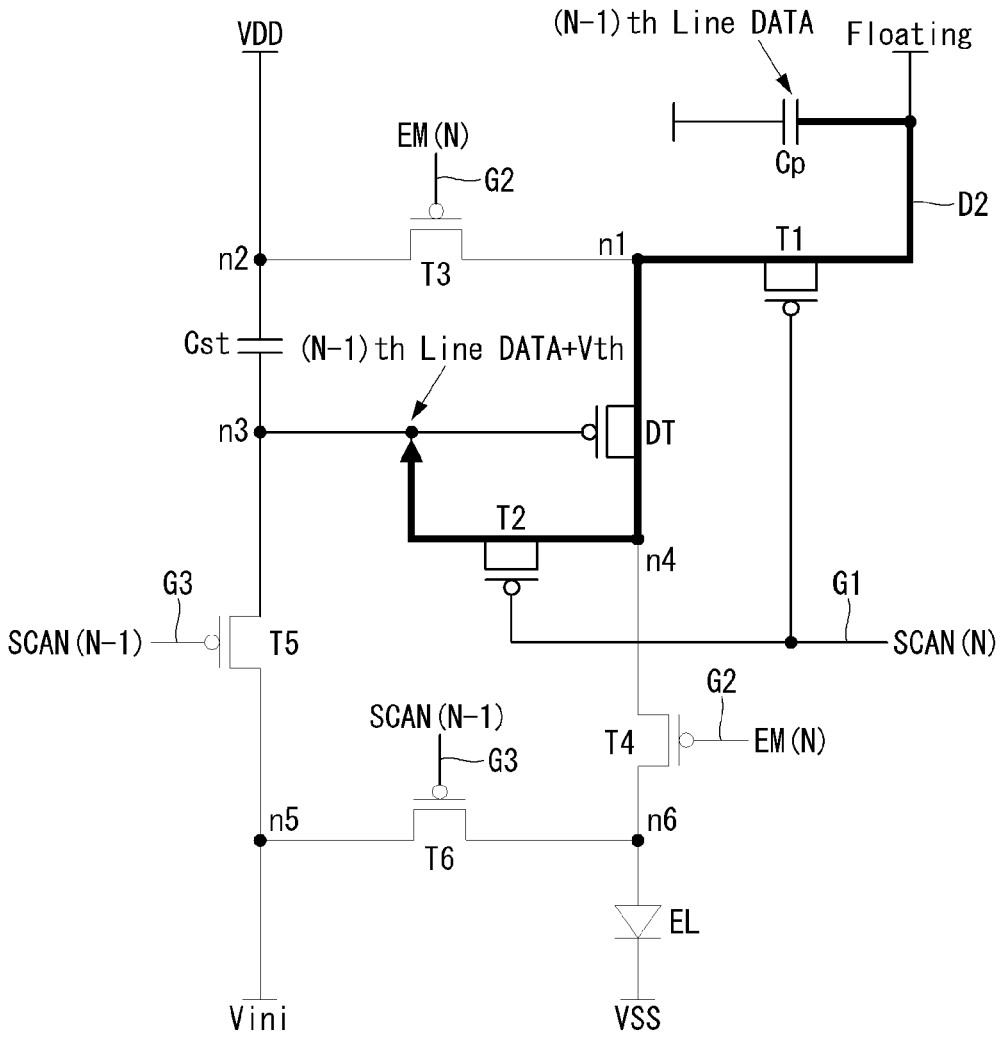
FIGS. 10A and 10B illustrate an operation of a second subpixel when there is no switch array.
Figure 10B:
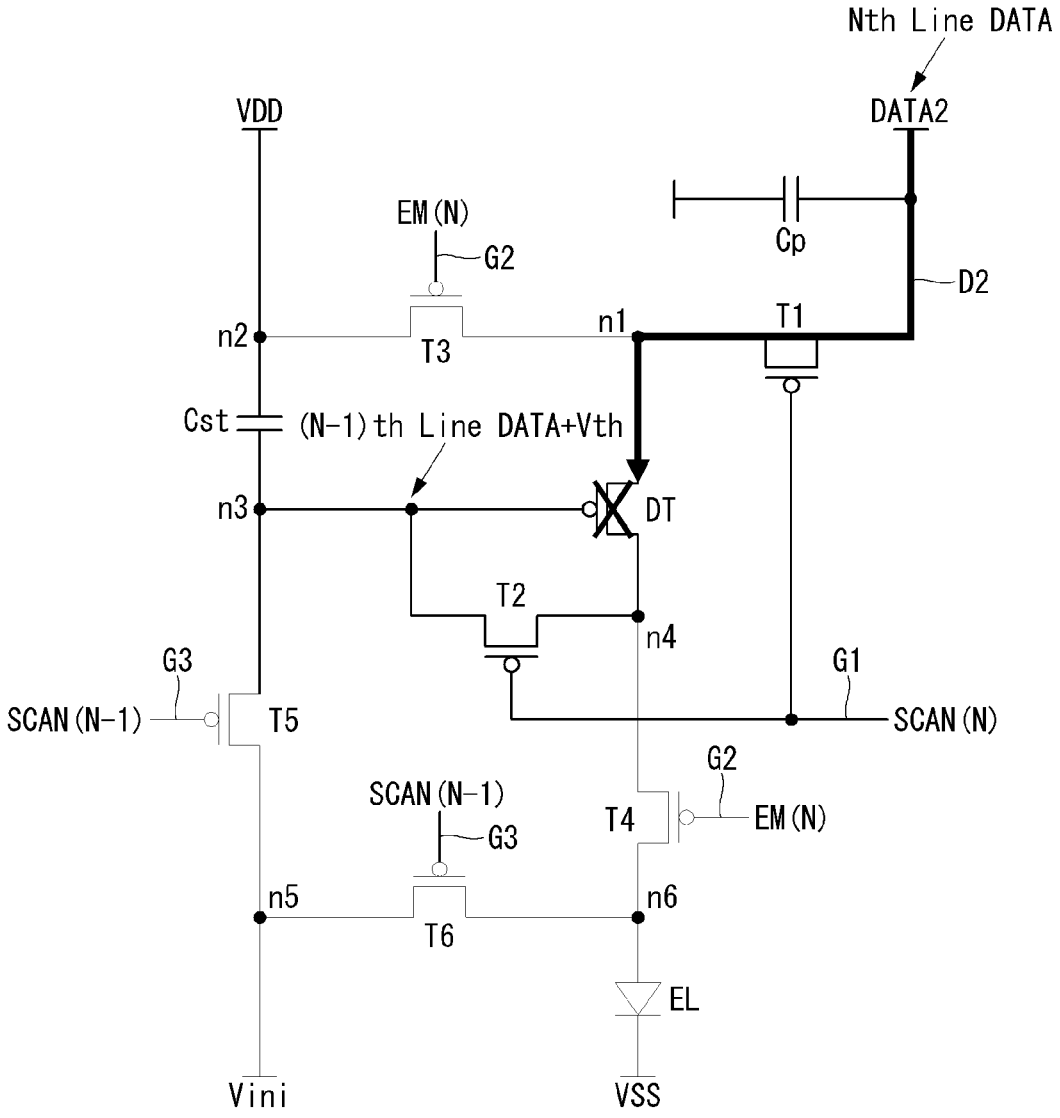

Each data line 102 of the display panel 100 includes a parasitic capacitance Cp. If the switch array 114 is not provided, the second subpixel 101B may malfunction due to the parasitic capacitance Cp as shown in FIGS. 10A and 10B. In particular, if the switch array 114 is not provided, the threshold voltage of the driving element may not be sensed in the pixel circuit when the second subpixel 101B is floated in the A period as shown in FIG. 3. Thus, aspects of the present disclosure can prevent the gate of the driving TFT DT from being floated by controlling the gate voltage of the driving TFT DT of the second subpixel 101B to the initialization voltage Vini in the A period, thereby stably sensing the threshold voltage Vth of the driving TFT DT.

When the switch array 114 is not provided, the first data line D1 is charged with the first data signal DATA1 during the A period and then is floated during the B period. On the other hand, the second data line D2 is floated during the A period and then is charged with the second data signal DATA2 during the B period.

Figure 9:
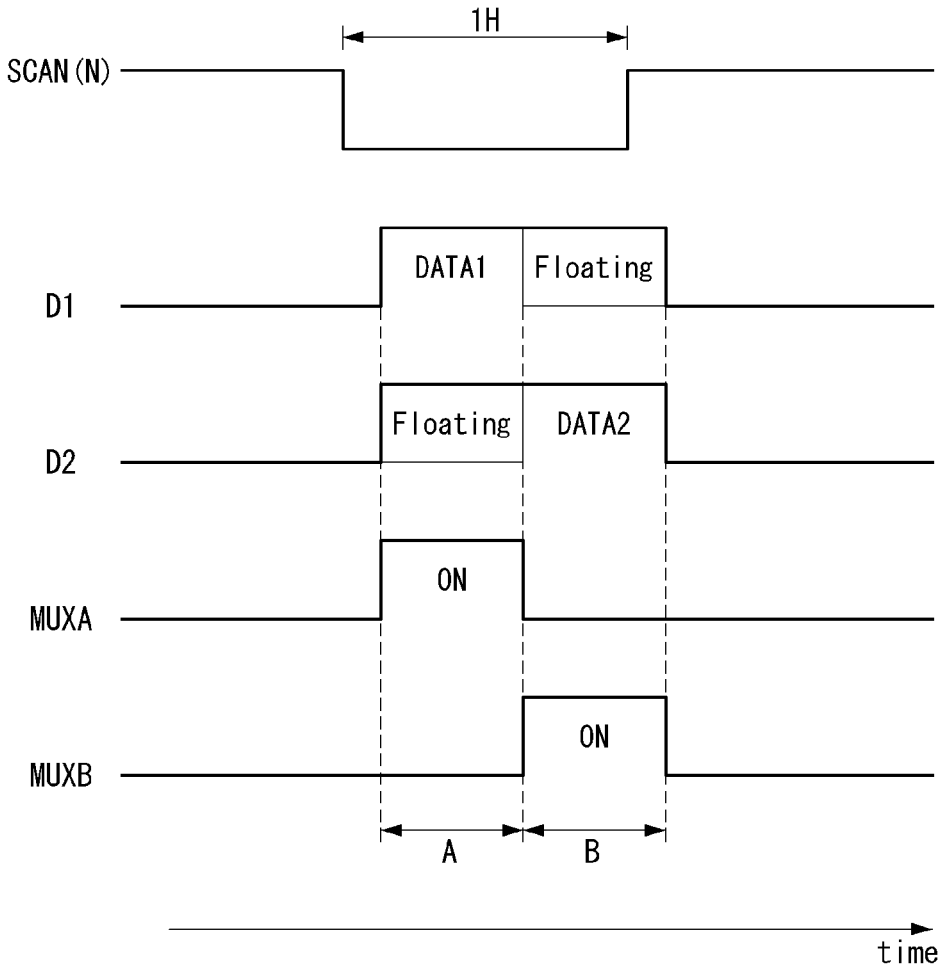
FIG. 9 is a waveform diagram illustrating a floating time of data lines when there is no switch array.

FIG. 9 is a waveform diagram illustrating a floating time of data lines when there is no switch array. FIGS. 10A and 10B illustrate an operation of a second subpixel when there is no switch array.

Referring to FIG. 10A, the Nth scan signal SCAN(N) is generated as a pulse of the gate-on voltage in the Twr operation. During the A period Twr-A, the (N−1)th scan signal SCAN(N−1) and the EM signal EM(N) are held at the gate-off voltage. During the A period Twr-A of the second subpixel 101B, the first and second switching TFTs T1 and T2 are turned on, and the remaining switching TFTs T3 to T6 maintain an off-state. In this instance, because the second switch element M2 of the demultiplexer 112 is turned off, the second data line D2 is floated and is held at a voltage of a data signal (N−1)th Line DATA of the (N−1)th pixel line charged in a parasitic capacitance Cp. Thus, in the A period Twr-A, the gate of the driving TFT DT is held at "(N−1)th Line DATA+Vth" that has been previously charged.

Referring to FIG. 10B, during the B period Twr-B, the first and second switching TFTs T1 and T2 are turned on, and the remaining switching TFTs T3 to T6 maintain an off-state. In this instance, data signals Nth Line DATA and DATA2 of the Nth pixel line are applied to the second data line D2 in synchronization with the Nth scan signal SCAN (N).

During the B period Twr-B, the gate voltage of the driving TFT DT is "(N−1)th Line DATA+Vth" different from the initialization voltage Vini. When "(N−1)th Line DATA+Vth" is greater than "Nth Line DATA", the driving TFT DT is turned off. Therefore, the gate voltage of the driving TFT DT cannot increase to "Nth Line DATA+Vth". Thus, in the second subpixel 101B, when the initialization voltage Vini is not applied to the second data line D2 during the A period, the threshold voltage Vth of the driving TFT DT cannot be sensed in the Twr operation.

Aspects of the disclosure set the second data line D2 connected to the second subpixel 101B to the initialization voltage Vini during the A period Twr-A of the second subpixel 101B as shown in FIG. 8A, thereby performing the sensing of the threshold voltage of the driving TFT DT of the second subpixel 101B in the Twr operation.

Figure 11:
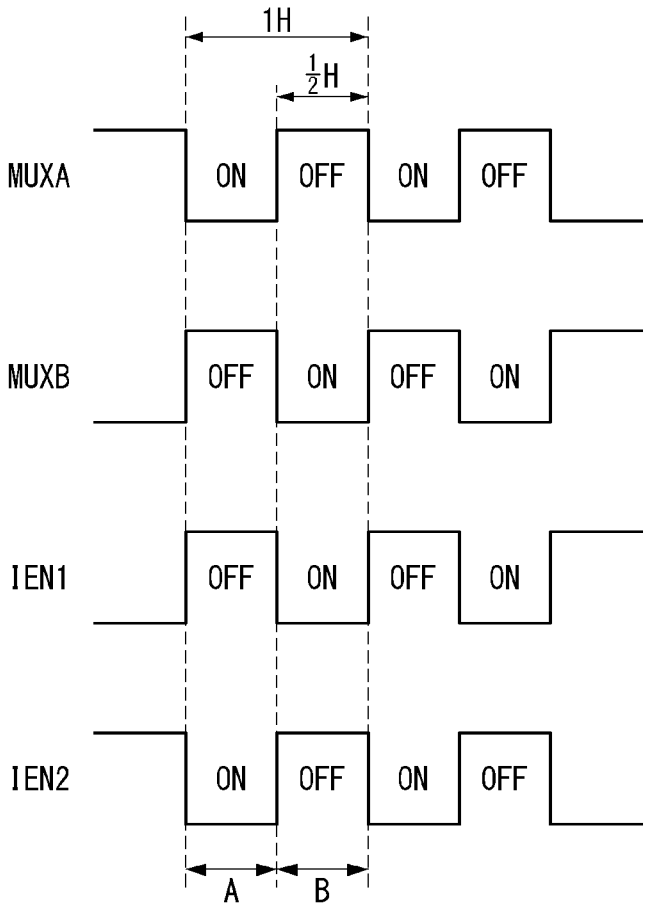
FIG. 11 is a waveform diagram illustrating a method for controlling a demultiplexer and a switch array according to a first aspect of the disclosure.
Figure 12A:
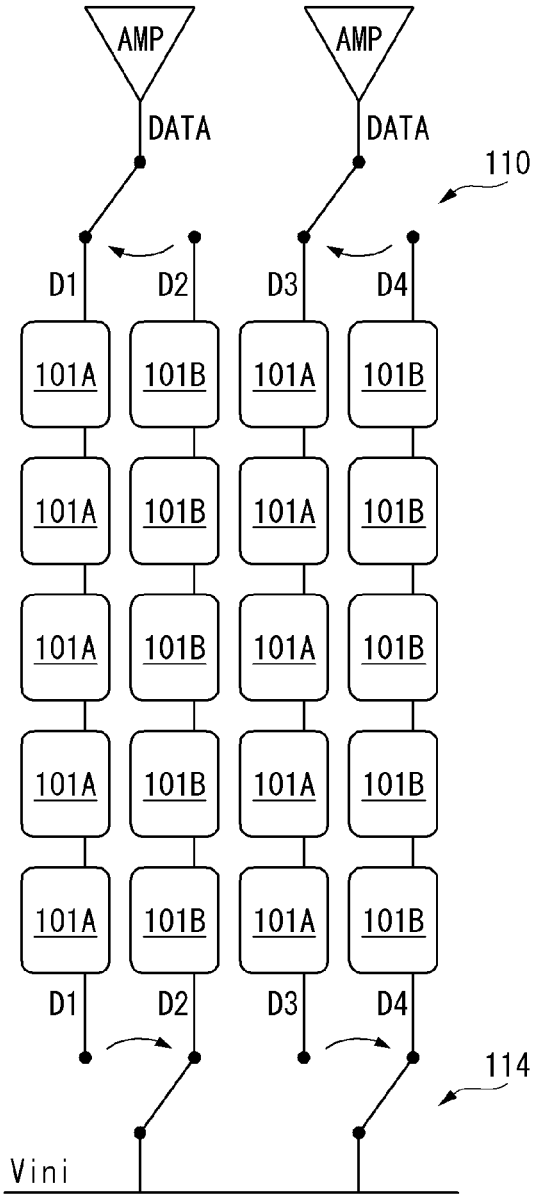
FIGS. 12A and 12B illustrate a demultiplexer and a switch array that are switched in response to a control signal shown in FIG. 11.
Figure 12B:
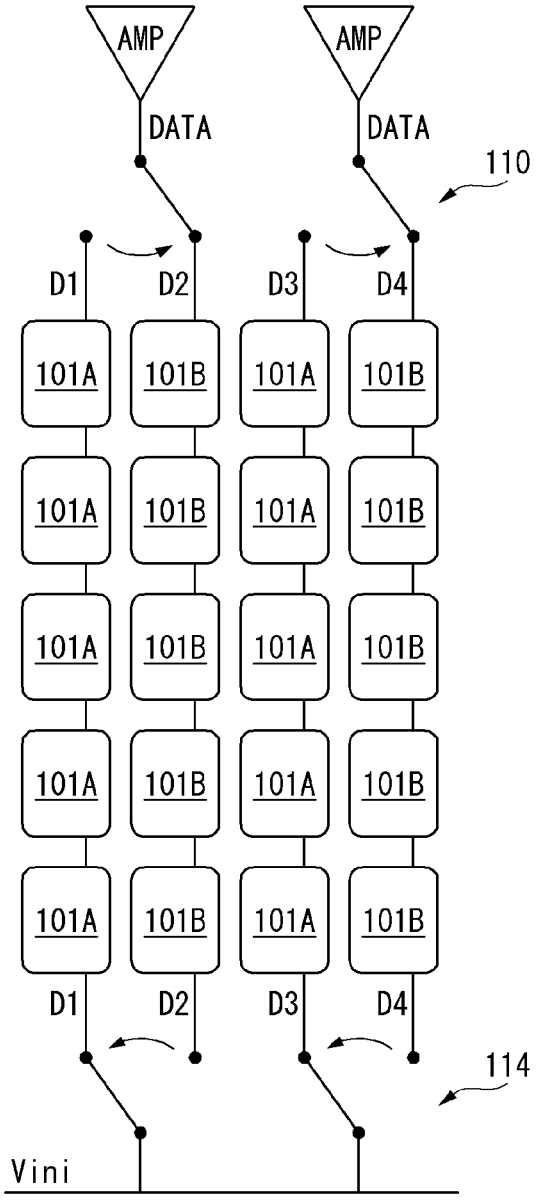

FIG. 11 is a waveform diagram illustrating a method for controlling a demultiplexer and a switch array according to a first aspect of the present disclosure. More specifically, FIG. 11 illustrates switch control signals MUXA, MUXB, IEN1 and IEN2 when switch elements of a demultiplexer 112 and a switch array 114 are implemented as PMOS transistors. The switch control signals MUXA, MUXB, IEN1 and IEN2 shown in FIG. 11 are substantially the same as those shown in FIGS. 4 and 5. FIGS. 12A and 12B illustrate a demultiplexer and a switch array that are switched in response to a control signal shown in FIG. 11.

Referring to FIGS. 11 and 12B, the demultiplexer 112 connects data lines D1 and D3 connected to a first pixel group to output terminals of the data driver 110 in response to the first switch control signal MUXA during an A period. Further, the demultiplexer 112 connects data lines D2 and D4 connected to a second pixel group to the output terminals of the data driver 110 in response to the second switch control signal MUXB during a B period. The first and second switch control signals MUXA and MUXB may be substantially generated in antiphase. Subpixels 101A belonging to the first pixel group may be connected to the odd-numbered data lines D1 and D3, and subpixels 101B belonging to the second pixel group may be connected to the even-numbered data lines D2 and D4. However, aspects are not limited thereto.

The switch array 114 supplies the initialization voltage Vini to the data lines D2 and D4 connected to the second pixel group in response to the first switch control signal IEN1 during the A period. The switch array 114 supplies the initialization voltage Vini to the data lines D1 and D3 connected to the first pixel group in response to the second switch control signal IEN2 during the B period.

The subpixels 101A of the first pixel group may be connected to the odd-numbered data lines D1 and D3, and the subpixels 101B of the second pixel group may be connected to the odd-numbered data lines D2 and D4. However, aspects are not limited thereto.

The first switch control signal MUXA of the demultiplexer 112 and the first switch control signal IEN1 of the switch array 114 are generated in antiphase. Further, the second switch control signal MUXB of the demultiplexer 112 and the second switch control signal IEN2 of the switch array 114 are generated in antiphase. Thus, as shown in FIG. 12A, during the A period, the data signal is applied to the first pixel group, and at the same time the initialization voltage Vini is applied to the second pixel group. Subsequently, as shown in FIG. 12B, during the B period, the data signal is applied to the second pixel group, and at the same time the initialization voltage Vini is applied to the first pixel group.

As described above with reference to FIGS. 7A to 8B, in the Twr operation, the first pixel group that is earlier supplied with the data signal can be normally driven when the first pixel group is supplied with the initialization voltage Vini or is floated after the receiving of the data signal.

Figure 13:
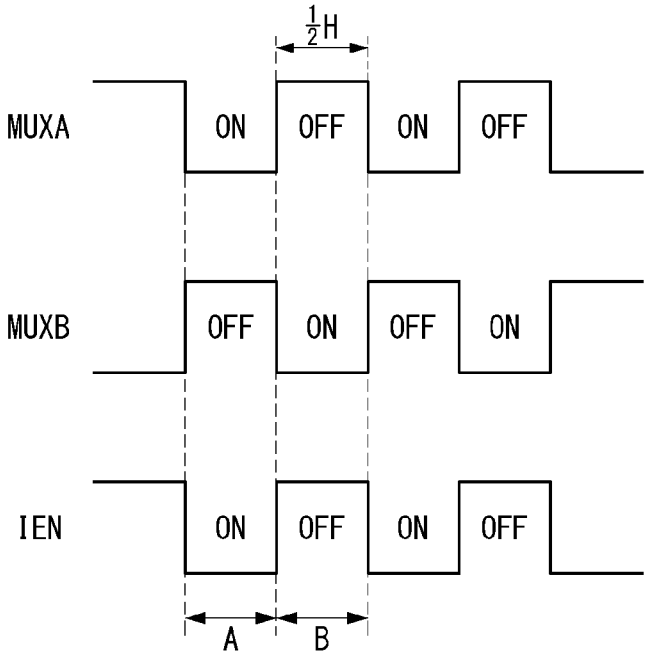
FIG. 13 is a waveform diagram illustrating a method for controlling a demultiplexer and a switch array according to a second aspect of the disclosure.
Figure 14A:
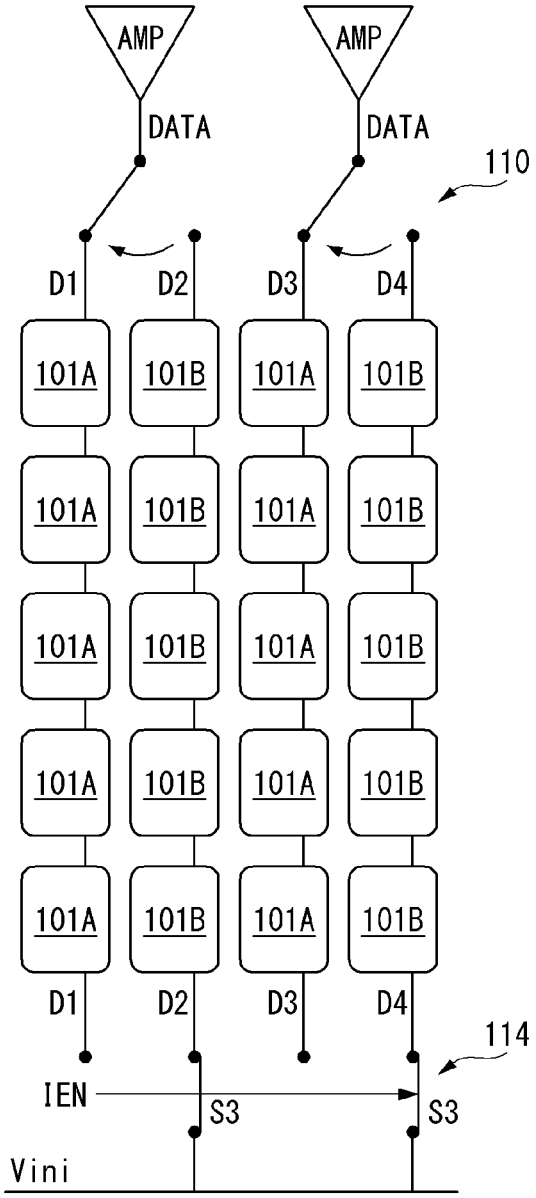
FIGS. 14A and 14B illustrate a demultiplexer and a switch array that are switched in response to a control signal shown in FIG. 13.
Figure 14B:
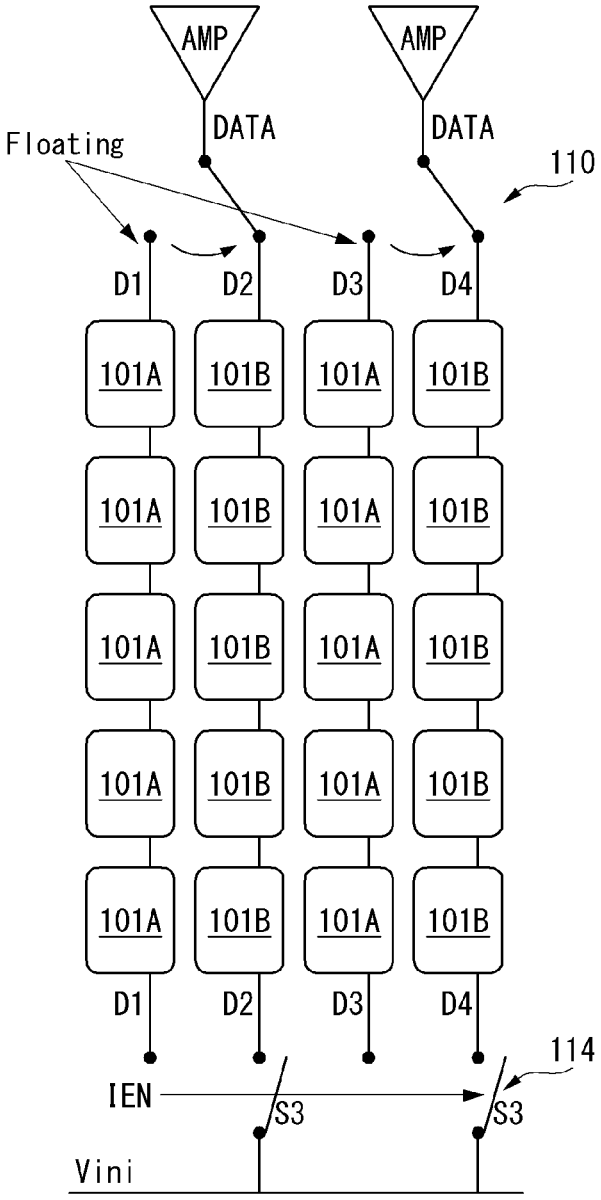

FIG. 13 is a waveform diagram illustrating a method for controlling a demultiplexer and a switch array according to a second aspect of the present disclosure. FIGS. 14A and 14B illustrate a demultiplexer and a switch array that are switched in response to a control signal shown in FIG. 13. FIGS. 13 to 14B illustrate a method for controlling the data lines connected to the first pixel group through the floating after the data signal is earlier applied to the first pixel group.

Referring to FIGS. 13 to 14B, the demultiplexer 112 connects data lines D1 and D3 connected to a first pixel group to output terminals of the data driver 110 in response to a first switch control signal MUXA during an A period. Further, the demultiplexer 112 connects data lines D2 and D4 connected to a second pixel group to the output terminals of the data driver 110 in response to a second switch control signal MUXB during a B period. The first and second switch control signals MUXA and MUXB may be substantially generated in antiphase. Subpixels 101A belonging to the first pixel group may be connected to the odd-numbered data lines D1 and D3, and subpixels 101B belonging to the second pixel group may be connected to the even-numbered data lines D2 and D4. However, aspects are not limited thereto.

A switch control signal IEN for controlling the switch array 114 and the first switch control signal MUXA of the demultiplexer 112 may be generated in phase. The switch array 114 includes switch elements S3 that supplies the initialization voltage Vini to the data lines D2 and D4 connected to the second pixel group in response to the switch control signal IEN during the A period. In the second aspect of the disclosure, the switch elements S3 of the switch array 114 do not need to be connected to the data lines D1 and D3 connected to the first pixel group. As described above with reference to FIGS. 7A and 7B, even if the data lines D1 and D3 connected to the first pixel group are floated in the B period, the threshold voltage of the driving TFT can be normally sensed in the pixel circuit.

The first switch control signal MUXA of the demultiplexer 112 and the first switch control signal IEN1 of the switch array 114 are generated in antiphase. Thus, as shown in FIG. 12A, during the A period, the data signal is applied to the first pixel group, and at the same time the initialization voltage Vini is applied to the second pixel group. Subsequently, as shown in FIG. 12B, during the B period, the data signal is applied to the second pixel group, and at the same time the initialization voltage Vini is applied to the first pixel group.

Figure 15:
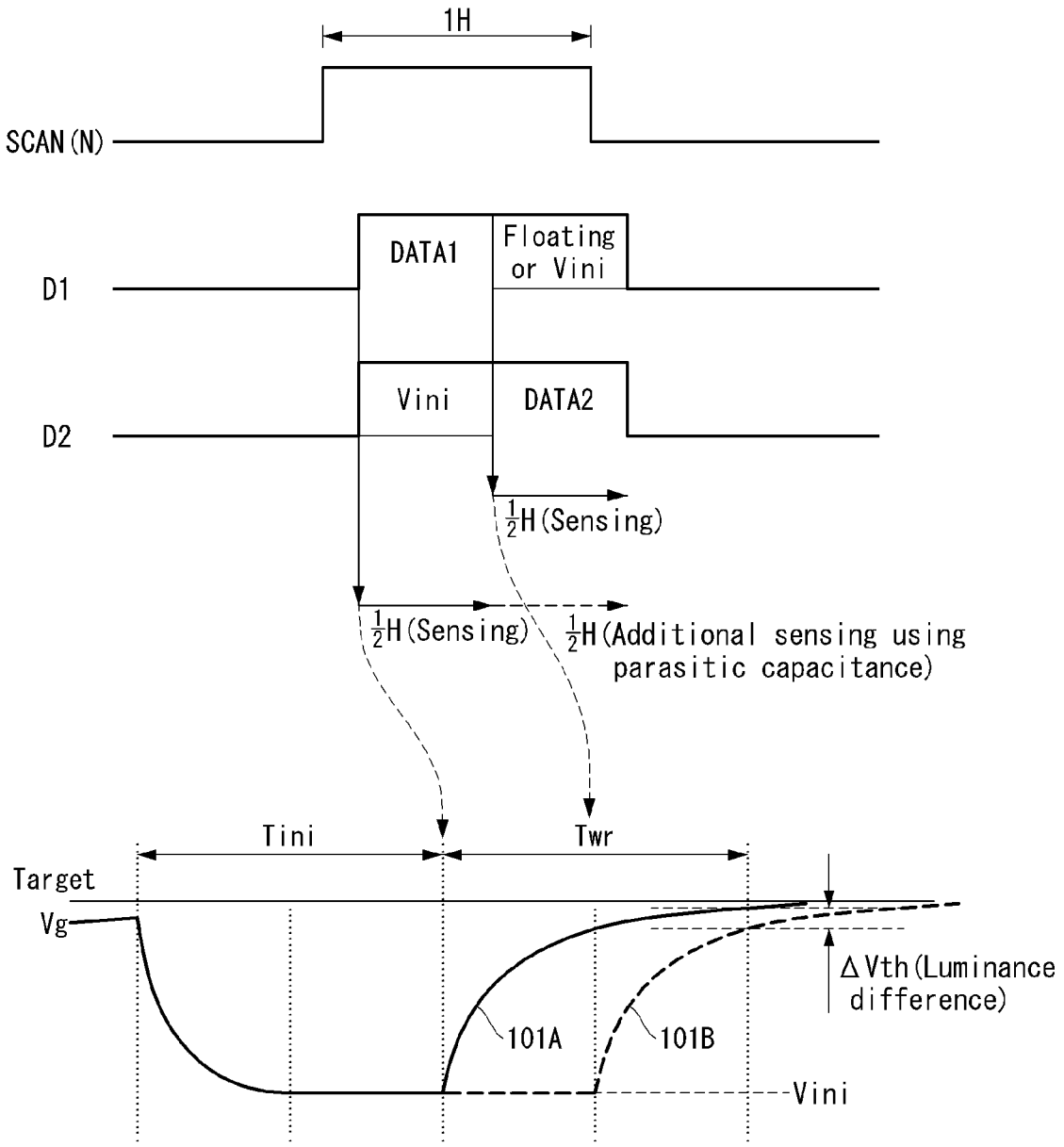
FIG. 15 illustrates a difference in a sensing time of a threshold voltage of a driving element between pixel groups.

FIG. 15 illustrates a difference in a sensing time of a threshold voltage of a driving element between pixel groups. In FIG. 15, "Vg" denotes a gate voltage (i.e., a voltage of a third node n3) of the driving TFT DT included in the pixel circuit.

Referring to FIG. 15, the first subpixel 101A receives the data signal DATA1 in the A period of the Twr operation to sense the threshold voltage of the driving TFT DT and receives a voltage stored in a parasitic capacitance Cp in the B period of the Twr operation to sense the threshold voltage of the driving TFT DT. On the other hand, the second subpixel 101B receives the data signal DATA2 in the B period of the Twr operation to sense the threshold voltage of the driving TFT DT. While the first subpixel 101A of the first pixel group senses the threshold voltage of the driving TFT DT during one horizontal period 1H, and the second subpixel 101B of the second pixel group senses the threshold voltage of the driving TFT DT during ½ horizontal period ½H. Therefore, there may be a difference ΔVth in the sensed threshold voltage between the first pixel group and the second pixel group. The difference may cause a luminance difference between the first pixel group and the second pixel group at the same gray level.

Figure 16:
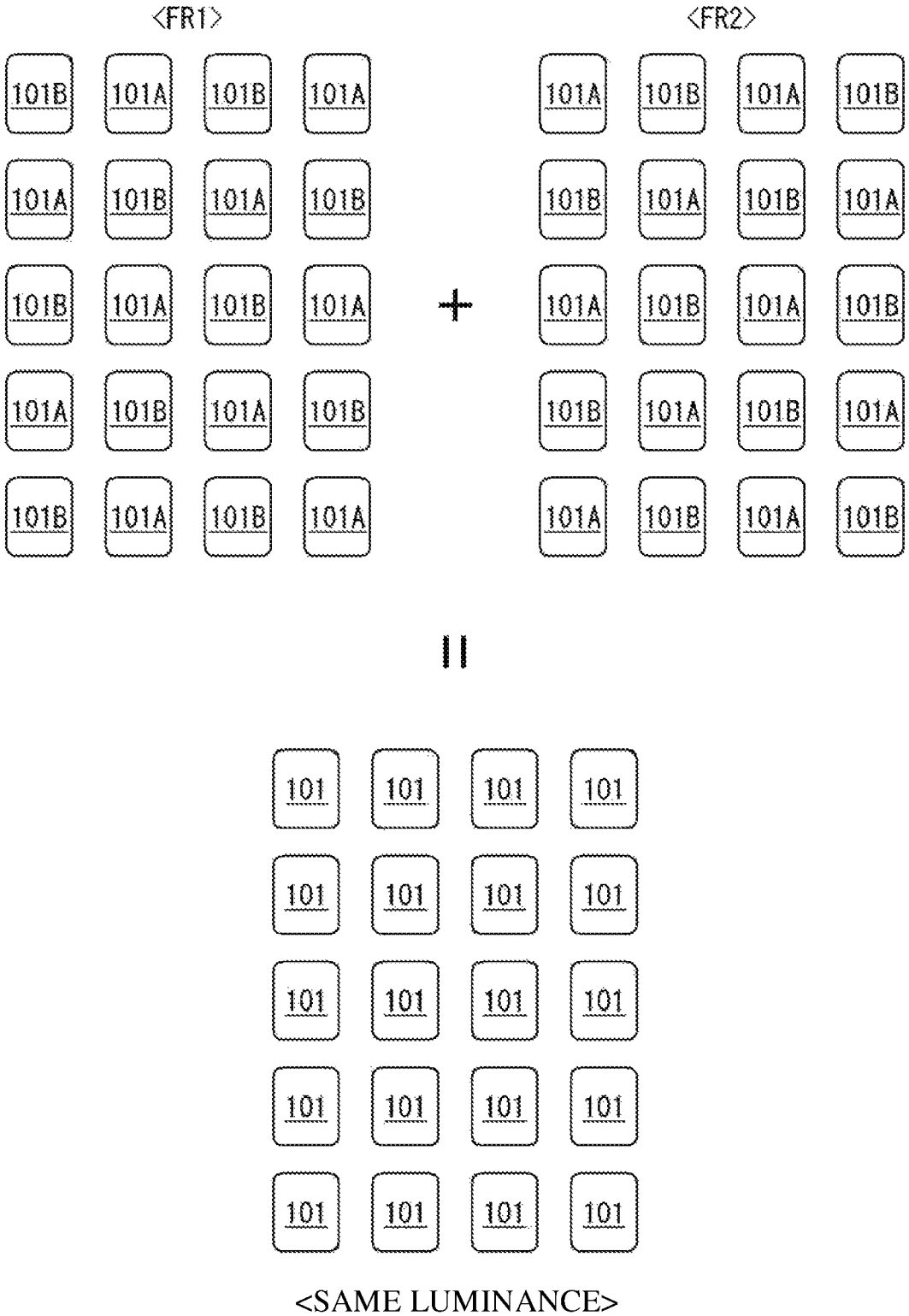
FIG. 16 illustrates a method for uniformly controlling a luminance between pixel groups by changing a switch control signal for controlling a demultiplexer by a predetermined time.

FIG. 16 illustrates a method for uniformly controlling a luminance between the pixel groups by changing the switch control signals MUXA and MUXB for controlling the demultiplexer 112 every a predetermined time.

Referring to FIG. 16, the first pixel group and the second pixel group are distinguished depending on charging order of the data voltage in the Twr operation. The data voltage charging order of the subpixels may be controlled by the switch control signals MUXA and MUXB for controlling the demultiplexer 112.

When the switch control signals MUXA and MUXB are inverted every a predetermined time, for example, every horizontal period, the subpixels 101A of the first pixel group and the subpixels 101B of the second pixel group are alternately arranged in one frame period at intervals of one subpixel. When the arrangement of the first and second pixel groups is the same in every frame period as described above, a luminance difference may occur based on one subpixel.

When the switch control signals MUXA and MUXB are inverted every horizontal period and are also inverted every frame period, the subpixels 101A of the first pixel group and the subpixels 101B of the second pixel group are positioned adjacent to each other in up, down, left and right directions in one frame period as shown in FIG. 16. Hence, the first pixel group and the second pixel group are spatially separated, and positions of the subpixels 101A of the first pixel group and positions of the subpixels 101B of the second pixel group are reversed in each frame period. As a result, an average luminance of subpixels 101 is the same in a first frame period FR1 and a second frame period FR2.

Figure 17:
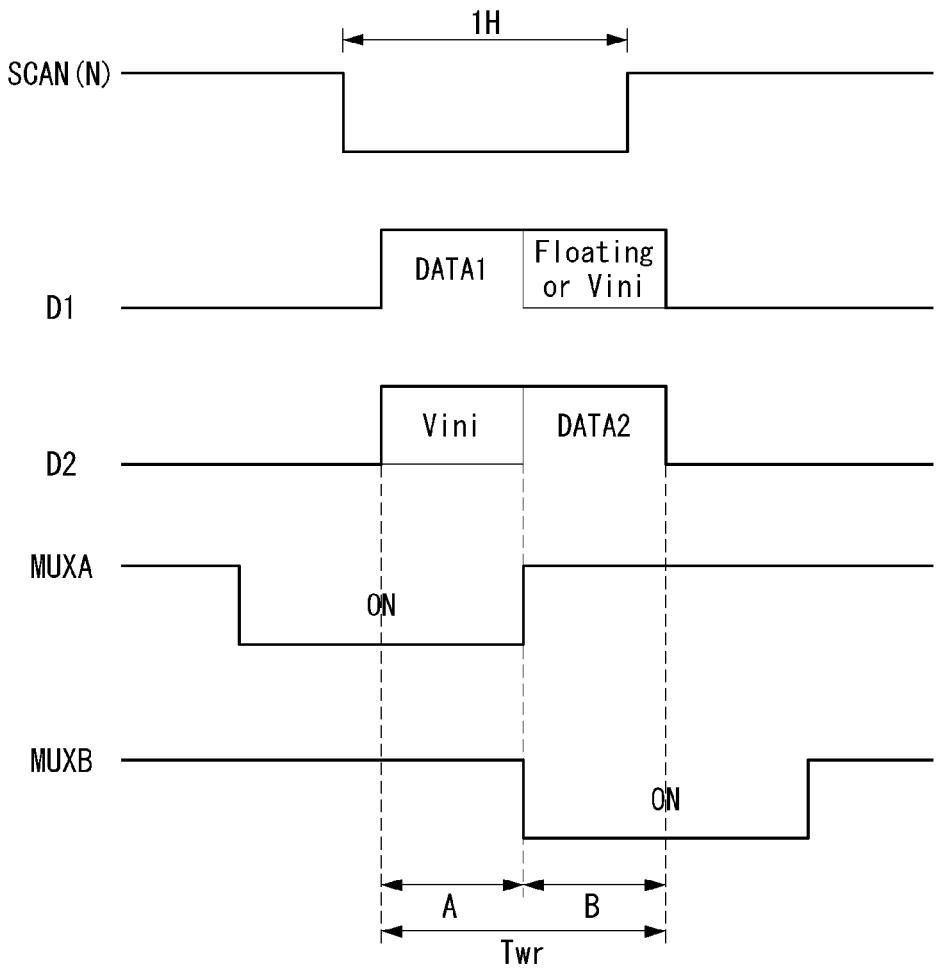
FIGS. 17 and 18 are waveform diagrams illustrating a method for reducing the number of switching operations of a demultiplexer.
Figure 18:
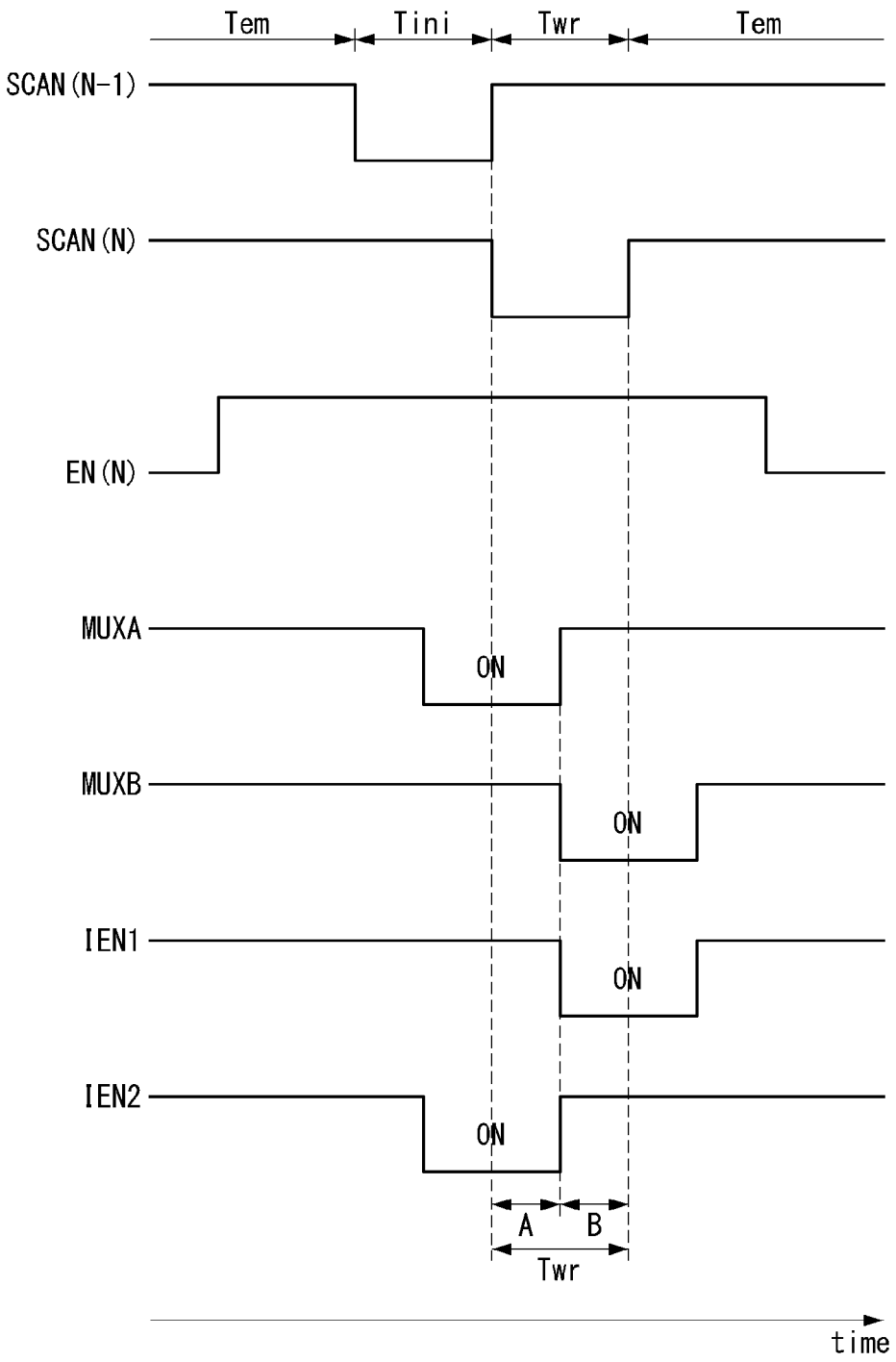

A method for reducing power consumption by reducing the number of switching operations of the demultiplexer is disclosed in U.S. Patent Publication No. 2016-0078826A1 (17 Mar. 2016) corresponding to the present applicant, and which are hereby incorporated by reference in their entirety. The method, as shown in FIGS. 17 and 18, increases an ON-time period of the switch control signals MUXA and MUXB for controlling the demultiplexer 112 to one horizontal period 1H in the same manner as an ON-time period of the scan signals SCAN(N−1) and SCAN(N) and supplies the data signal to subpixels disposed on two adjacent pixel lines in one horizontal period 1H in the time division manner.

A threshold voltage sensing time of the pixels is determined by ON-time of the demultiplexer 112 and ON-time of the scan signal synchronized with the data signal. Aspects of the disclosure can uniformly control spatially and in time a luminance of the pixels by properly changing an ON-time period of switch control signals MUX1 and MUX2 and an ON-time period of the scan signal in each frame period as shown in FIGS. 19A to 19D.

Figure 19A:
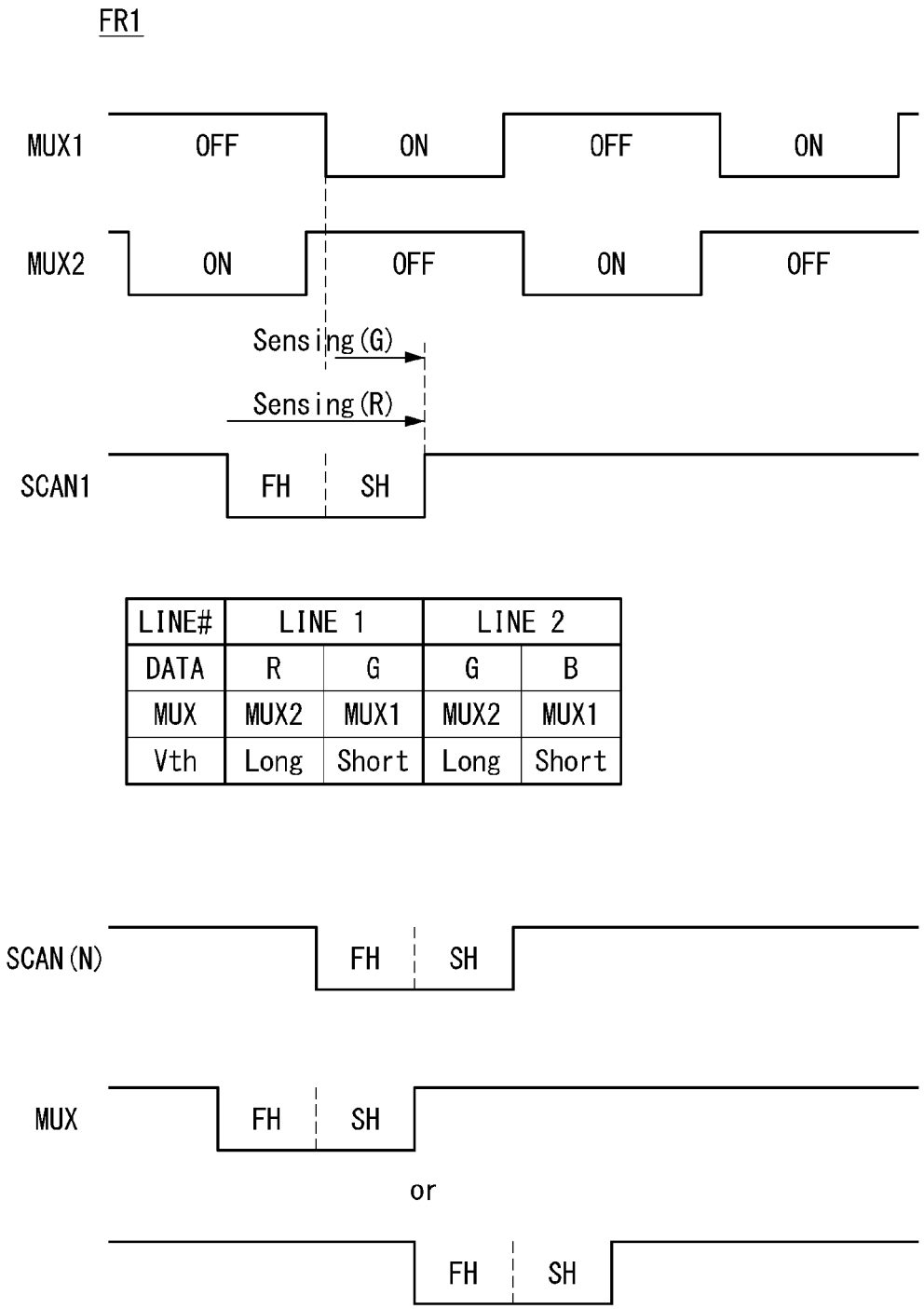
FIGS. 19A to 19D illustrate a method for changing a switch control signal for controlling a demultiplexer by a predetermined time.
Figure 19B:
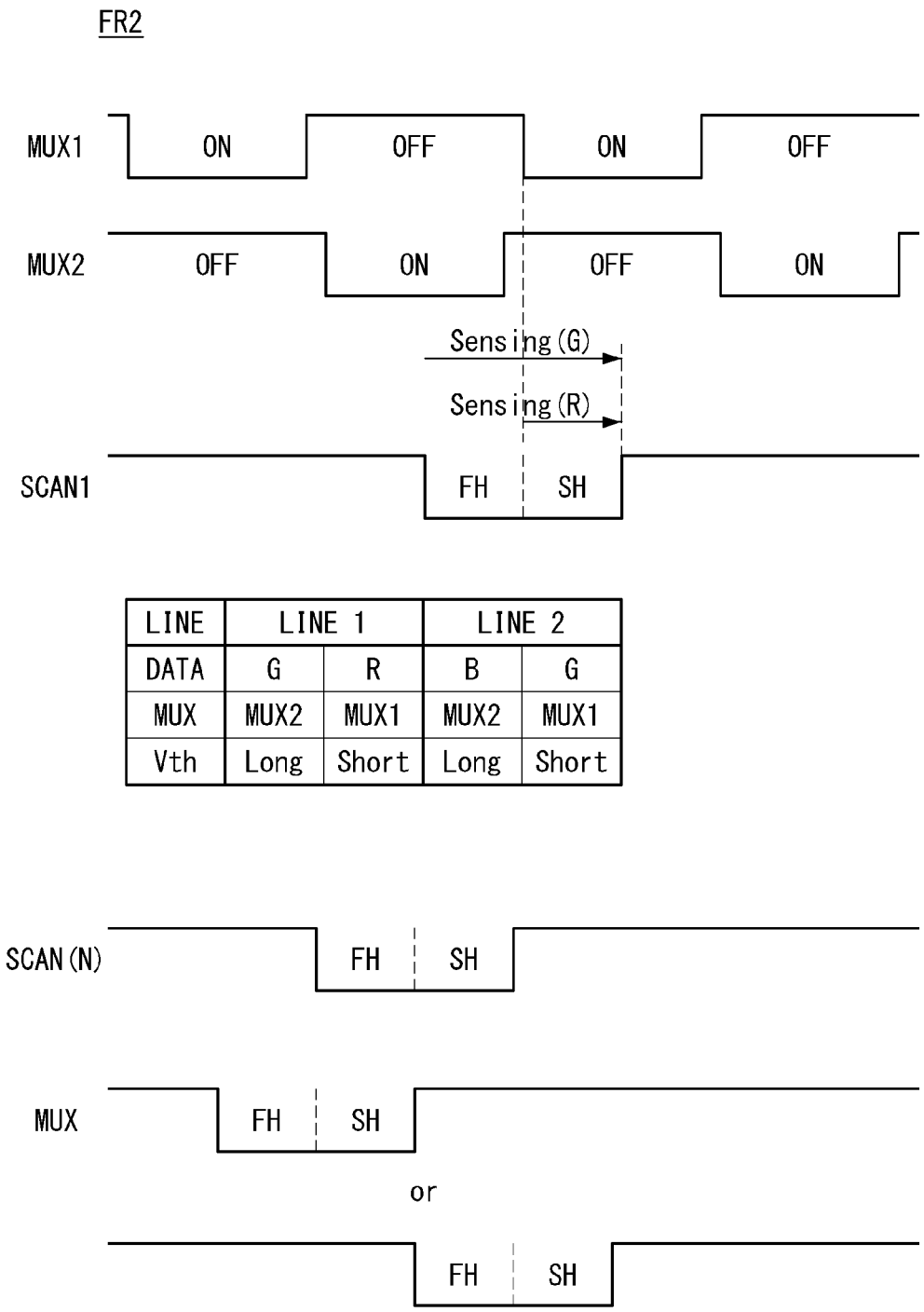
Figure 19C:
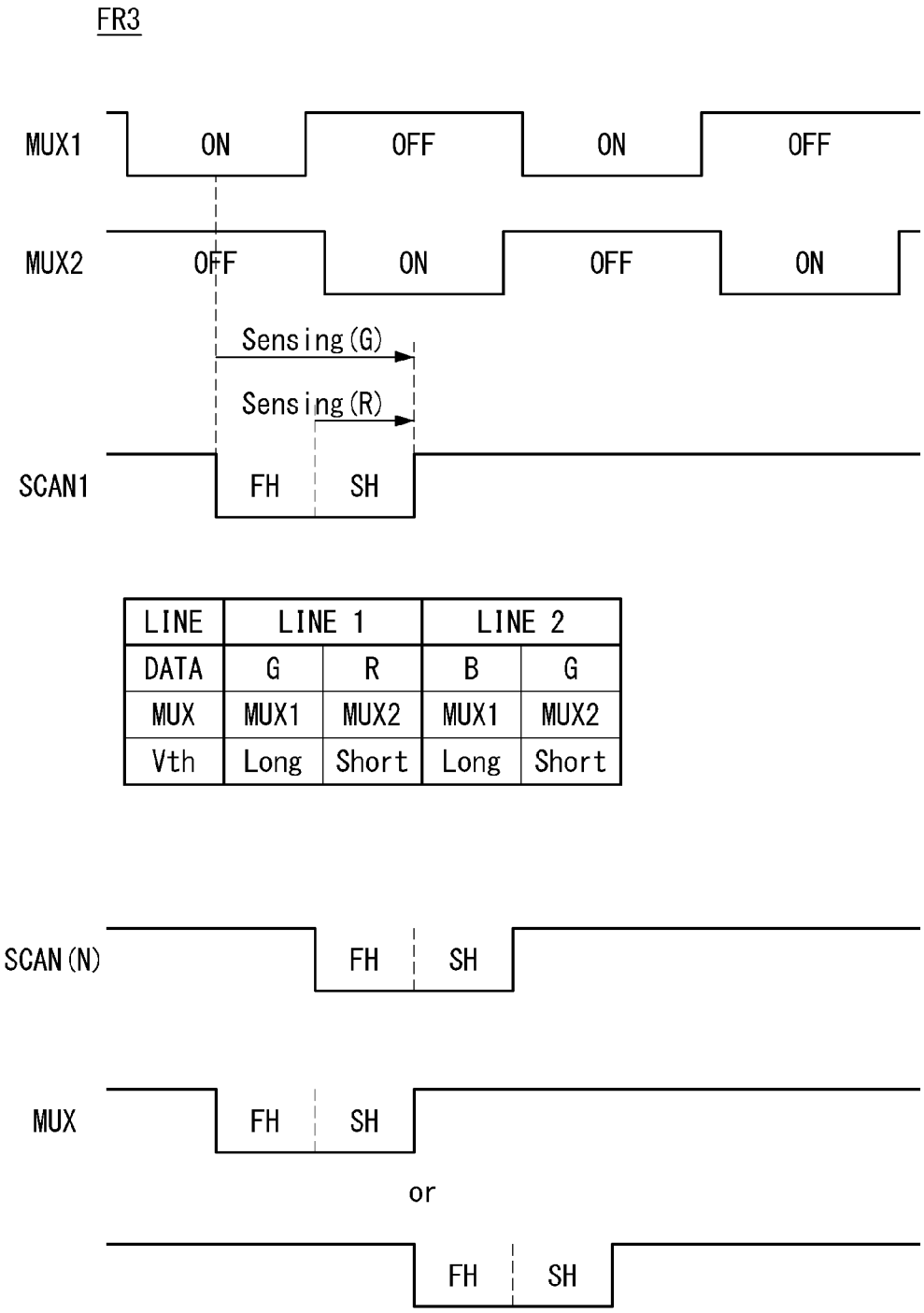
Figure 19D:
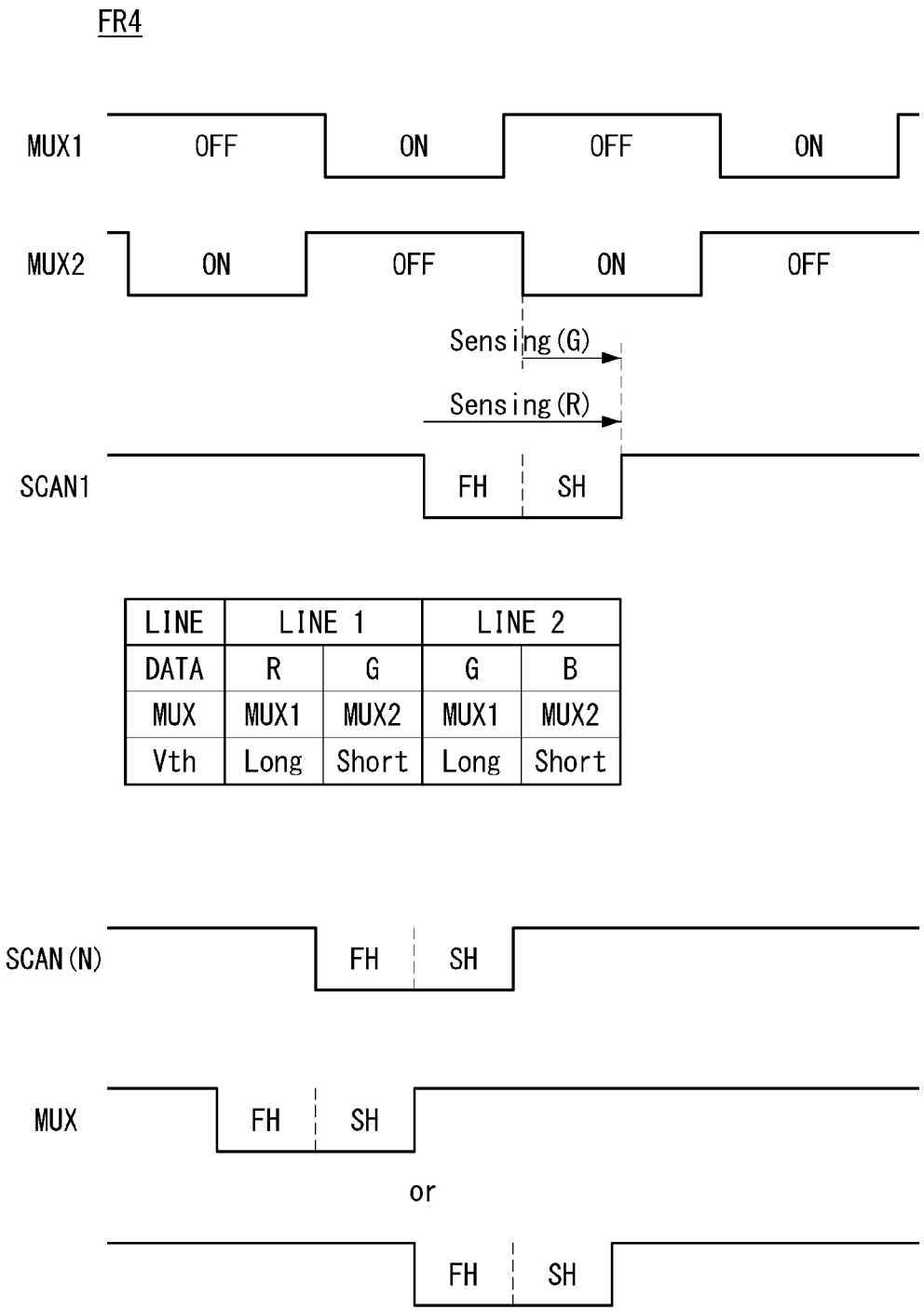

As shown in FIGS. 19A and 19B, the timing controller 130 can be configured such that an ON-time period of a second switch control signal MUX2 is earlier than an ON-time period of a first switch control signal MUX1 in a first frame period FR1, and then an ON-time period of the first switch control signal MUX1 is earlier than an ON-time period of the second switch control signal MUX2 in a second frame period FR2. Further, as shown in FIGS. 19C and 19D, the timing controller 130 can be configured such that an ON-time period of the first switch control signal MUX1 is earlier than an ON-time period of the second switch control signal MUX2 in a third frame period FR3, and then an ON-time period of the second switch control signal MUX2 is earlier than an ON-time period of the first switch control signal MUX1 in a fourth frame period FR4. The switch control signals MUX1 and MUX2 can be inverted every one horizontal period 1H, so that subpixels of a first pixel group and subpixels of a second pixel group in adjacent pixel lines are alternately arranged at intervals of one subpixel as shown in FIG. 16. A luminance of the pixels can be uniformly controlled by properly combining waveforms shown in FIGS. 19A to 19D.

Referring again to FIG. 2, in a first pixel line LINE1, a red subpixel R is connected to a first data line D1, and a green subpixel G is connected to a second data line D2. In a second pixel line LINE2, a blue subpixel B is connected to the first data line D1, and a green subpixel G is connected to the second data line D2. In the following description, the red subpixel R connected to the first data line D1 in the first pixel line LINE1 is referred to as the "R subpixel", and the green subpixel G connected to the second data line D2 in the first pixel line LINE1 is referred to as the "G subpixel".

The switch control signals MUXA and MUXB shown in FIG. 2 may be changed to the switch control signals MUX1 and MUX2 shown in FIGS. 19A to 19D. In this instance, in a first frame period FR1, the MUXA may be generated as the MUX2, and the MUXB may be generated as the MUX1 of which ON-time is later than ON-time of the MUX2. In a second frame period FR2, the MUXA may be generated as the MUX1, and the MUXB may be generated as the MUX2 of which ON-time is earlier than ON-time of the MUX1. In a third frame period FR3, the MUXA may be generated as the MUX2, and the MUXB may be generated as the MUX1 of which ON-time is earlier than ON-time of the MUX2. In a fourth frame period FR4, the MUXA may be generated as the MUX1, and the MUXB may be generated as the MUX2 of which ON-time is earlier than ON-time of the MUX1. The timing controller 130 controls operation timing of the demultiplexer 112 and operation timing of the gate driver 120 and thus can change the scan signal and the switch control signal in each frame period as shown in FIGS. 19A to 19D.

Referring to FIGS. 19A to 19D, the Nth scan signal SCAN(N) and the switch control signal MUX define a threshold voltage sensing time of the driving TFT DT. A threshold voltage sensing value of the pixels is affected by a voltage of the data signal supplied in an ON-time period of the demultiplexer 112 and an ON-time period of the scan signal synchronized with the data signal. The ON-time period of the demultiplexer 112 is determined by the switch control signal MUX. A threshold voltage sensing time of the pixels may be determined by a multiplication of the ON-time period of the switch control signal MUX and the ON-time period of the scan signal SCAN(N). In FIGS. 19A to 19D, "Sensing(R)" denotes a threshold voltage sensing time of a driving TFT DT of the R subpixel, and "Sensing (G)" denotes a threshold voltage sensing time of a driving TFT DT of the G subpixel.

The ON-time period of the switch control signal MUX is divided into a first portion FH corresponding to a first half of the pulse and a second portion SH corresponding to a second half of the pulse. In the same manner as the switch control signal MUX, the ON-time period of the scan signal SCAN(N) is divided into a first portion FH corresponding to a first half of the pulse and a second portion SH corresponding to a second half of the pulse. In the following description, a first scan signal SCAN1 and the switch control signals MUX1 and MUX2 are abbreviated as reference marks.

The SCAN1 generated in the first frame period FR1 is synchronized with data signals R and G applied to the subpixels of the first pixel line LINE1. The data signal R is supplied to the first data line D1 through the first switch element M1, which is turned on in response to the MUX2, and is supplied to the R subpixel in the first portion FH of the SCAN1. The data signal G is supplied to the second data line D2 through the second switch element M2, which is turned on in response to the MUX1, and is supplied to the G subpixel in the second portion SH of the SCAN1. The R subpixel operates in the same manner as the first subpixel 101A in the first frame period FR1. Because the R subpixel starts to be charged with the voltage of the data signal from an overlap period of the second portion SH of the MUX2 and the first portion FH of the SCAN1 in the first frame period FR1, the R subpixel senses the threshold voltage of the driving TFT during about one horizontal period 1H and compensates for the data voltage as much as the sensed threshold voltage. On the other hand, the G subpixel operates in the same manner as the second subpixel 101B in the first frame period FR1. Because the G subpixel starts to be charged with the voltage of the data signal from an overlap period of the first portion FH of the MUX1 and the second portion SH of the SCAN1 in the first frame period FR1, the G subpixel senses the threshold voltage of the driving TFT during about ½ horizontal period (½)H and compensates for the data voltage as much as the sensed threshold voltage.

The SCAN1 generated in the second frame period FR2 is synchronized with data signals R and G applied to the subpixels of the first pixel line LINE1. The data signal R is supplied to the first data line D1 through the first switch element M1, which is turned on in response to the MUX1, and is supplied to the R subpixel in the second portion SH of the SCAN1. The data signal G is supplied to the second data line D2 through the second switch element M2, which is turned on in response to the MUX2, and is supplied to the G subpixel in the first portion FH of the SCAN1. The R subpixel operates in the same manner as the second subpixel 101B in the second frame period FR2. Because the R subpixel starts to be charged with the voltage of the data signal from an overlap period of the first portion FH of the MUX1 and the second portion SH of the SCAN1 in the second frame period FR2, the R subpixel senses the threshold voltage of the driving TFT during about ½ horizontal period (½)H and compensates for the data voltage as much as the sensed threshold voltage. On the other hand, the G subpixel operates in the same manner as the first subpixel 101A in the second frame period FR2. Because the G subpixel starts to be charged with the voltage of the data signal from an overlap period of the second portion SH of the MUX2 and the first portion FH of the SCAN1 in the second frame period FR2, the G subpixel senses the threshold voltage of the driving TFT during about one horizontal period 1H and compensates for the data voltage as much as the sensed threshold voltage.

The SCAN1 generated in the third frame period FR3 is synchronized with data signals R and G applied to the subpixels of the first pixel line LINE1. The data signal R is supplied to the first data line D1 through the first switch element M1, which is turned on in response to the MUX2, and is supplied to the R subpixel in the second portion SH of the SCAN1. The data signal G is supplied to the second data line D2 through the second switch element M2, which is turned on in response to the MUX1, and is supplied to the G subpixel in the first portion FH of the SCAN1. The R subpixel operates in the same manner as the second subpixel 101B in the third frame period FR3. Because the R subpixel starts to be charged with the voltage of the data signal from an overlap period of the first portion FH of the MUX2 and the second portion SH of the SCAN1 in the third frame period FR3, the R subpixel senses the threshold voltage of the driving TFT during about ½ horizontal period (½)H and compensates for the data voltage as much as the sensed threshold voltage. On the other hand, the G subpixel operates in the same manner as the first subpixel 101A in the third frame period FR3. Because the G subpixel starts to be charged with the voltage of the data signal from an overlap period of the second portion SH of the MUX1 and the first portion FH of the SCAN1 in the third frame period FR3, the G subpixel senses the threshold voltage of the driving TFT during about one horizontal period 1H and compensates for the data voltage as much as the sensed threshold voltage.

The SCAN1 generated in the fourth frame period FR4 is synchronized with data signals R and G applied to the subpixels of the first pixel line LINE1. The data signal R is supplied to the first data line D1 through the first switch element M1, which is turned on in response to the MUX1, and is supplied to the R subpixel in the first portion FH of the SCAN1. The data signal G is supplied to the second data line D2 through the second switch element M2, which is turned on in response to the MUX2, and is supplied to the G subpixel in the second portion SH of the SCAN1. The R subpixel operates in the same manner as the first subpixel 101A in the fourth frame period FR4. Because the R subpixel starts to be charged with the voltage of the data signal from an overlap period of the second portion SH of the MUX1 and the first portion FH of the SCAN1 in the fourth frame period FR4, the R subpixel senses the threshold voltage of the driving TFT during about one horizontal period 1H and compensates for the data voltage as much as the sensed threshold voltage. On the other hand, the G subpixel operates in the same manner as the second subpixel 101B in the fourth frame period FR4. Because the G subpixel starts to be charged with the voltage of the data signal from an overlap period of the first portion FH of the MUX2 and the second portion SH of the SCAN1 in the fourth frame period FR4, the G subpixel senses the threshold voltage of the driving TFT during about ½ horizontal period (½)H and compensates for the data voltage as much as the sensed threshold voltage.

When the R subpixel is driven in the method illustrated in FIGS. 19A to 19D, a threshold voltage sensing time of the R subpixel in the first to fourth frame periods FR1 to FR4 is as follows:

FR1: (SH of MUX2)×(FH of SCAN1)
FR2: (FH of MUX1)×(SH of SCAN1)
FR3: (FH of MUX2)×(SH of SCAN1)
FR4: (SH of MUX1)×(FH of SCAN1)

When the R subpixel is driven in the method illustrated in FIGS. 19A to 19D, a threshold voltage sensing time of the driving TFT DT in the first to fourth frame periods FR1 to FR4 is changed to long→short→short→long. The threshold voltage sensing time is affected by the ON-time period of the switch control signal MUX and the ON-time period of the scan signal SCAN(N) as described above. When the threshold voltage sensing time is more affected by the ON-time period of the switch control signal MUX (i.e., the ON-time period of the demultiplexer 112), the threshold voltage sensing time is changed to short→long→short→long when the subpixels are driven in order of the following frame periods FR1→FR2→FR3→FR4. Hence, a cycle of the threshold voltage sensing time is short. When the threshold voltage sensing time is more affected by the ON-time period of the scan signal SCAN(N), the threshold voltage sensing time is changed to short→long→long→short when the subpixels are driven in order of the following frame periods FR1→FR2→FR3→FR4. Hence, the cycle of the threshold voltage sensing time increases. When the subpixels are driven in order of the following frame periods FR1→FR2→FR4→FR3, the threshold voltage sensing time is changed to short→long→short→long.

As described above, the pixels according to the aspects of the disclosure are driven in the initialization operation, the operation of sensing the threshold voltage and writing data in the driving element, and the emission operation. Thus, the aspects of the present disclosure can compensate for the threshold voltage of each of the driving elements included in all the pixels and achieve the uniform luminance.

The aspects of the disclosure time-divide the data signals output through one output terminal of the data driver and distribute the divided data signals to the data lines through the demultiplexer. Further, the aspects of the disclosure supply the predetermined reference voltage using the switch array at the moment, when the data line is floated, in the operation of sensing the threshold voltage and writing data in the driving element. As a result, the aspects of the disclosure can prevent malfunction of the subpixels resulting from the parasitic capacitance The aspects of the disclosure can implement the compensation circuit in which there is no difference in a sensing time of the threshold voltage of the driving element between the pixels, by properly combining the ON-time period of the demultiplexer and the ON-time period of the gate signal (or the scan signal) every a predetermined time. Hence, the aspects of the disclosure can implement the image quality in which there is no difference in the luminance between all the pixels.

Although aspects have been described with reference to a number of illustrative aspects thereof, it should be understood that numerous other modifications and aspects can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An electroluminescent display comprising:

a data driver configured to sequentially output a first data signal and a second data signal through an output terminal;

a first data line charged with the first data signal;

a second data line charged with the second data signal;

a first subpixel connected to the first data line;

a second subpixel connected to the second data line;

a gate line commonly connected to the first and second subpixels and configured to simultaneously supply a gate signal to the first and second subpixels;

a demultiplexer including a first MUX switch element configured to connect the output terminal of the data driver to the first data line and a second MUX switch element configured to the output terminal to the second data line, wherein the first and second MUX switch elements alternately turned-on; and a switch array including a first REF switch element and a second REF switch element, wherein the second REF switch element is configured to supply a predetermined reference voltage to the second data line when the output terminal of the data driver is connected to the first data line by the first MUX switch element, and the first REF switch element is configured to supply the predetermined reference voltage to the first data line when the output terminal of the data driver is connected to the second data line by the second MUX switch element, wherein each of the first and second subpixels includes a pixel circuit, wherein the pixel circuit includes a driving element for driving a light emitting element and a plurality of switch elements, wherein the pixel circuit is initialized in an initialization operation, senses a threshold voltage of the driving element in a sensing operation, and emits light in an emission operation.

2. The electroluminescent display of claim 1, wherein the first MUX switch element is configured to connect the output terminal to the first data line in response to a first MUX switch control signal; and the second MUX switch element is configured to connect the output terminal to the second data line in response to a second MUX switch control signal, wherein each of the first and second MUX switch control signals is generated as a pulse having an ON-time period of ½ horizontal period or one horizontal period, wherein the second MUX switch control signal is generated subsequent to the first MUX switch control signal.

3. The electroluminescent display of claim 2, wherein the first MUX switch control signal and the second MUX switch control signal are inverted every frame period.

4. The electroluminescent display of claim 2, wherein the first MUX switch control signal and the second MUX switch control signal are inverted every horizontal period and are inverted every frame period.

5. The electroluminescent display of claim 2, wherein the first REF switch element is configured to supply the reference voltage to the first data line in response to a first REF switch control signal; and the second REF switch element is configured to supply the reference voltage to the second data line in response to a second REF switch control signal, wherein the first REF switch control signal and the first MUX switch control signal are generated in antiphase, wherein the second REF switch control signal and the second MUX switch control signal are generated in antiphase.

6. The electroluminescent display of claim 5, wherein the gate signal includes an (N−1)th scan signal, an Nth scan signal generated subsequent to the (N−1)th scan signal, and an emission switching signal controlling a current path of the light emitting element, where N is a positive integer greater than zero, wherein the gate line includes a first gate line supplied with the Nth scan signal, a second gate line supplied with the emission switching signal, and a third gate line supplied with the (N−1)th scan signal.

7. The electroluminescent display of claim 1, wherein the sensing operation includes:

a first period in which the first data signal is applied to the first data line, and the reference voltage is supplied to the second data line; and a second period in which the second data signal is applied to the second data line, and the first data line is floated or supplied with the reference voltage.

8. The electroluminescent display of claim 1, wherein the first REF switch element and the second REF switch element alternately turned-on.

9. A display panel connected to a data driver sequentially outputting a first data signal and a second data signal through an output terminal of the data driver, comprising:

a first data line charged with the first data signal;

a second data line charged with the second data signal;

a first subpixel connected to the first data line;

a second subpixel connected to the second data line;

a gate line commonly connected to the first and second subpixels and simultaneously supplying a gate signal to the first and second subpixels;

a demultiplexer including a first MUX switch element configured to connect the output terminal of the data driver to the first data line and a second MUX switch element configured to connect the output terminal to the second data line, wherein the first and second MUX switch elements alternately turned-on; and a switch array including a first REF switch element and a second REF switch element, wherein the second REF switch element is configured to supply a predetermined reference voltage to the second data line when the output terminal of the data driver is connected to the first data line by the first MUX switch element, and the first REF switch element is configured to supply the predetermined reference voltage to the first data line when the output terminal of the data driver is connected to the second data line by the second MUX switch element.

10. The display panel of claim 9, wherein the first MUX switch element is configured to connect the output terminal to the first data line in response to a first MUX switch control signal; and the second MUX switch element is configured to connect the output terminal to the second data line in response to a second MUX switch control signal, wherein each of the first and second MUX switch control signals is generated as a pulse having an ON-time period of ½ horizontal period or one horizontal period, wherein the second MUX switch control signal is generated subsequent to the first MUX switch control signal.

11. The display panel of claim 10, wherein the first MUX switch control signal and the second MUX switch control signal are inverted every frame period.

12. The display panel of claim 10, wherein the first MUX switch control signal and the second MUX switch control signal are inverted every horizontal period and are inverted every frame period.

13. The display panel of claim 10, wherein the the first REF switch element is configured to supply the reference voltage to the first data line in response to a first REF switch control signal; and the second REF switch element is configured to supply the reference voltage to the second data line in response to a second REF switch control signal, wherein the first REF switch control signal and the first MUX switch control signal are generated in antiphase, wherein the second REF switch control signal and the second MUX switch control signal are generated in antiphase.

14. The display panel of claim 10, wherein each of the first and second subpixels includes a pixel circuit, wherein the pixel circuit includes a driving element for driving a light emitting element and a plurality of switch elements, wherein the pixel circuit is initialized in an initialization operation, senses a threshold voltage of the driving element in a sensing operation, and emits light in an emission operation.

15. The display panel of claim 14, wherein the gate signal includes an (N−1)th scan signal, an Nth scan signal generated subsequent to the (N−1)th scan signal, and an emission switching signal controlling a current path of the light emitting element, where N is a positive integer greater than zero, wherein the gate line includes a first gate line supplied with the Nth scan signal, a second gate line supplied with the emission switching signal, and a third gate line supplied with the (N−1)th scan signal.

16. The display panel of claim 15, wherein the light emitting element includes an emission layer between an anode and a cathode, wherein the driving element includes a transistor including a first electrode connected to a first node, a second electrode connected to a fourth node, and a gate connected to a third node, wherein each switch element of the pixel circuit includes a transistor.

17. The display panel of claim 16, wherein the pixel circuit includes:

a capacitor between a second node supplied with a predetermined pixel driving voltage and the third node;

a first switch element configured to connect the first data line or the second data line to the first node in response to the Nth scan signal;

a second switch element configured to connect the third node to the fourth node in response to the Nth scan signal;

a third switch element configured to connect the second node to the first node in response to the emission switching signal;

a fourth switch element configured to connect the fourth node to a sixth node connected to the anode of the light emitting element in response to the emission switching signal;

a fifth switch element configured to connect the third node to a fifth node supplied with the reference voltage in response to the (N−1)th scan signal; and a sixth switch element configured to connect the fifth node to the sixth node in response to the (N−1)th scan signal.

18. The display panel of claim 17, wherein in the initialization operation, a pulse of an ON-time period in the (N−1)th scan signal is generated, and the fifth switch element and the sixth switch element are turned on, wherein in the sensing operation, a pulse of an ON-time period in the Nth scan signal is generated, and the first switch element and the second switch element are turned on, wherein in the emission operation, the third switch element and the fourth switch element are turned on due to an ON-time period of the emission switching signal.

19. The display panel of claim 18, wherein the sensing operation includes:

a first period in which the first data signal is applied to the first data line, and the reference voltage is supplied to the second data line; and a second period in which the second data signal is applied to the second data line, and the first data line is floated or supplied with the reference voltage.

20. The display panel of claim 9, wherein the first REF switch element and the second REF switch element alternately turned-on.

* * * * *